US007942787B2

(12) United States Patent
Ohrt et al.

(10) Patent No.: US 7,942,787 B2
(45) **Date of Patent: *May 17, 2011**

(54) EXERCISE MACHINE

(75) Inventors: John Arthur Ohrt, Redmond, WA (US); James A. Duncan, Renton, WA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/636,814

(22) Filed: Dec. 14, 2009

(65) Prior Publication Data

US 2010/0093499 A1 Apr. 15, 2010

Related U.S. Application Data

(63) Continuation of application No. 11/767,873, filed on Jun. 25, 2007, now Pat. No. 7,632,219, which is a continuation of application No. 10/742,702, filed on Dec. 19, 2003, now Pat. No. 7,341,542, which is a continuation of application No. 09/823,362, filed on Mar. 30, 2001, now Pat. No. 6,689,019.

(51) Int. Cl.
*A63B 22/00* (2006.01)
*A63B 69/16* (2006.01)

(52) U.S. Cl. ..... 482/52; 482/62; 482/51

(58) Field of Classification Search ..... 482/51–53, 482/57, 70, 79–80

See application file for complete search history.

(56) References Cited

U.S. PATENT DOCUMENTS 4,768,775 A 9/1988 Marshall
5,299,993 A * 4/1994 Habing ..... 482/52
5,336,141 A 8/1994 Vittone
5,496,235 A 3/1996 Stevens
5,499,956 A * 3/1996 Habing et al. ..... 482/52
5,577,985 A * 11/1996 Miller ..... 482/52
5,611,756 A * 3/1997 Miller ..... 482/52
5,735,773 A * 4/1998 Vittone et al. ..... 482/52
5,743,834 A 4/1998 Rodgers, Jr.
5,766,113 A 6/1998 Rodgers, Jr.
5,836,854 A 11/1998 Kuo
5,848,954 A 12/1998 Stearns et al.
5,865,712 A 2/1999 Chang
5,910,072 A 6/1999 Rawls et al.
6,176,814 B1 1/2001 Ryan et al.
6,217,486 B1 4/2001 Rosenow
6,338,698 B1 1/2002 Stearns et al.
6,361,476 B1 3/2002 Eschenbach (Continued)

OTHER PUBLICATIONS

U.S. Appl. No. 09/255,404, filed Feb. 22, 1999, Rawls et al.

(Continued)

*Primary Examiner* — Steve R Crow
(74) *Attorney, Agent, or Firm* — Dorsey & Whitney LLP

(57) ABSTRACT

An exercise device providing a fore and aft horizontal component of striding motion that is dynamically user-defined, while providing a vertical component of the motion that is maintained on a predetermined vertically reciprocating path in some embodiments. The exercise device guides the user's foot in a pseudo-elliptical stride path, while providing a dynamically variable stride length that allows the user to move with a natural stride length. The exercise device allows tall and short users to extend or curtail the stride length to match their natural stride lengths. The length of the reciprocating path is dynamically adjusted during the exercise operation without equipment adjustments by changes in the length of the stride input by the user at a pair of foot engagement pads disposed on laterally spaced apart foot support members.

14 Claims, 18 Drawing Sheets

U.S. PATENT DOCUMENTS

| | | | |
|---|---|---|---|
| 6,554,750 | B2 | 4/2003 | Stearns et al. |
| 6,612,969 | B2 | 9/2003 | Eschenbach |
| 6,629,909 | B1 | 10/2003 | Stearns et al. |
| 6,648,800 | B2 | 11/2003 | Stearns et al. |
| 6,689,019 | B2 | 2/2004 | Ohrt et al. |
| 6,755,769 | B2 | 6/2004 | Johnston |
| 6,875,160 | B2 | 4/2005 | Watterson et al. |
| 7,169,088 | B2 | 1/2007 | Rodgers, Jr. |
| 7,169,089 | B2 | 1/2007 | Rodgers, Jr. |
| 7,172,531 | B2 | 2/2007 | Rodgers, Jr. |
| 7,179,201 | B2 | 2/2007 | Rodgers, Jr. |
| 7,201,705 | B2 | 4/2007 | Rodgers, Jr. |
| 7,214,168 | B2 | 5/2007 | Rodgers, Jr. |
| 7,244,217 | B2 | 7/2007 | Rodgers, Jr. |
| 7,276,017 | B2 | 10/2007 | Chen |
| 7,316,632 | B2 | 1/2008 | Rodgers, Jr. |
| 7,316,633 | B2 | 1/2008 | Liao et al. |
| 7,341,542 | B2 | 3/2008 | Ohrt et al. |
| 7,462,134 | B2 | 12/2008 | Lull et al. |
| 7,632,219 | B2 | 12/2009 | Ohrt et al. |
| 7,736,278 | B2 | 6/2010 | Lull et al. |
| 2002/0142890 | A1 | 10/2002 | Ohrt et al. |
| 2004/0132583 | A1 | 7/2004 | Ohrt et al. |
| 2004/0248704 | A1 | 12/2004 | Rodgers, Jr. |
| 2005/0026752 | A1 | 2/2005 | Lull et al. |
| 2005/0202939 | A1 | 9/2005 | Lull et al. |
| 2005/0209060 | A1 | 9/2005 | Lull |
| 2006/0003868 | A1 | 1/2006 | Lull et al. |
| 2006/0166791 | A1 | 7/2006 | Liao et al. |
| 2007/0087906 | A1 | 4/2007 | Rodgers |
| 2007/0087907 | A1 | 4/2007 | Rodgers |
| 2008/0125291 | A1 | 5/2008 | Watt et al. |
| 2008/0312045 | A1 | 12/2008 | Lull et al. |

OTHER PUBLICATIONS

U.S. Appl. No. 12/815,616, filed Jun. 15, 2010, Lull et al.
U.S. Appl. No. 12/839,232, filed Jul. 19, 2010, Lull et al.

* cited by examiner

EXERCISE MACHINE

CROSS-REFERENCE TO RELATED APPLICATIONS

This application is a continuation of U.S. application Ser. No. 11/767,873, filed Jun. 25, 2007, which is a continuation of U.S. application Ser. No. 10/742,702, filed Dec. 19, 2003, now U.S. Pat. No. 7,341,542, which is a continuation of U.S. application Ser. No. 09/823,362, filed Mar. 30, 2001, now U.S. Pat. No. 6,689,019, which are hereby incorporated in their entireties by reference as though fully disclosed herein.

FIELD OF THE INVENTION

This invention relates generally to exercise equipment, and in particular to stationary elliptical motion striding equipment.

BACKGROUND OF THE INVENTION

A variety of exercise apparatus exists which allow the user to exercise by simulating a striding motion. Some exercise devices allow a stepping motion. For example, U.S. Pat. No. 5,242,343, entitled "Stationary Exercise Device," illustrates an exercise device that includes a pair of foot-engaging links for a striding motion. One end of each foot link is supported for rotational motion about a pivot access, and a second end of each foot link is guided in a reciprocal path of travel. The combination of these two foot link motions permits the user's foot to travel in an inclined, generally oval path of travel. The resulting foot action exercises a large number of muscles through a wide range of motion. The exercise device includes a pair of bell cranks, similar to the bell cranks used with bicycle pedals, traveling in identical circular paths 180 degrees apart. The circular paths each have a fixed diameter, which is a function of the fixed length of the bell crank web. The first end of each foot link is pinned to the outer end of one of the bell cranks, and thus also travels in a circular path of a fixed diameter. The second ends of the foot links are either slidingly or rollingly engaged with a linear track, or suspended by a swinging link arm, such that the rotary motion of the first ends of the foot links and the reciprocating motion of the second ends of the foot links, in combination, result in a reciprocating, pseudo-elliptical foot path for the foot pad positioned between the first and second ends of each foot link and on which a user stands. The fixed resulting foot path is a predetermined, machine-defined path that is variable only by manually changing physical parameters of the equipment. Thus, while the exercise device may provide a foot action that exercises a large number of muscles through a wide range of motion, it confines the range of motion by limiting the path traveled by the first ends of the foot links to the circular path of the bell cranks.

SUMMARY OF THE INVENTION

One embodiment of the exercise device of the present invention is distinguished from the known so-called "elliptical" motion exercise machines by providing a fore and aft horizontal component of striding motion that is dynamically user-defined, while providing a vertical component of the motion that is maintained on a predetermined vertically reciprocating path. While the user's foot motion is guided in a generally elliptical path, the present invention provides a dynamically variable stride length, which allows the user to move with a natural stride length, within the range of the manufactured product. Thus, a tall or short user is able to extend or curtail the stride length to match his or her natural stride length, and the stride length desired for the level of exercise being performed. The length of the reciprocating path is dynamically adjusted during the exercise operation without equipment adjustments or stopping the exercise being performed by changes in the length of the stride input by the user at a pair of laterally spaced apart foot engagement members. As the user's legs move with a longer striding motion or a shorter striding motion during exercise, the equipment automatically compensates by similarly increasing or decreasing the relative length-wise displacement of the two foot engagement members. Thus, in contrast to prior art devices, the length and shape of the reciprocating path followed by the user's feet is dynamically variable as a function of the user's input, without changing physical parameters or settings of the exercise machine.

The operation of the two foot engagement members is either dependent or independent depending on the construction of the embodiment of the invention. In other words, the two foot engagement members are either operatively interconnected by an interconnection member, or operatively disconnected from one another for independent foreaft movement.

Furthermore, one aspect of the invention uses a cam/cam follower arrangement to minimize or soften the jolting accelerations and decelerations associated with known fixed stride-length exercise machines. The cams react in response to the extended or shortened length of a user's stride.

In several embodiments, a transmission utilizing a speed-up drive mode of resistance and flywheel for inertia is coupled to the reciprocating foot engagement members to further smooth the operation, especially the vertical component of the motion. A resistance to the striding motion may be input under user control to enhance the exercise experience by resisting one or both of the vertical and horizontal components of motion.

According to another aspect of the invention, a first foot engagement member is supported for first and second reciprocating motions within a first substantially vertical plane, and a second foot engagement member is supported for first and second reciprocating motions within a second substantially vertical plane laterally spaced away from the first plane at a convenient distance to accommodate a human user.

In some embodiments of the invention, one of the first and second reciprocating motions of the first foot engagement member is interdependent with respective first and second reciprocating motions of the second foot engagement member with both of its vertical and horizontal components. In other embodiments, interdependency is only with respect to the vertical component. In other words, the length component of the striding motion practiced by one of the user's legs is independent of the corresponding length component practiced by the user's other leg during exercise. In other embodiments of the invention, the striding motion practiced is the same with respect to the length component as a result of the two foot engagement members being tied together through an interconnection between the foot engagement members, such that a cooperation or "dependency" is maintained between the reciprocating motions of the user's two feet during exercise in the horizontal component.

According to one aspect of the invention, the first horizontal component of the reciprocal foot motion is dynamically user-defined by varying the length of the stride input by the user at the respective foot engagement member, without accompanying changes to the physical parameters of the exercise machine. According to the invention, the variation in the length of the stride is infinite, within the physical bounds of the exercise machine as manufactured.

In one embodiment of the invention, the height of the vertical component of the reciprocal foot motion is also dynamically user-defined by varying the height of the stride input by the user at the respective foot engagement members, also without accompanying changes to the physical parameters of the exercise machine. Accordingly, the variation in the height of the stride is also infinite, within the physical bounds of the specific embodiment of exercise machine.

DETAILED DESCRIPTION OF THE INVENTION

Figure 1:
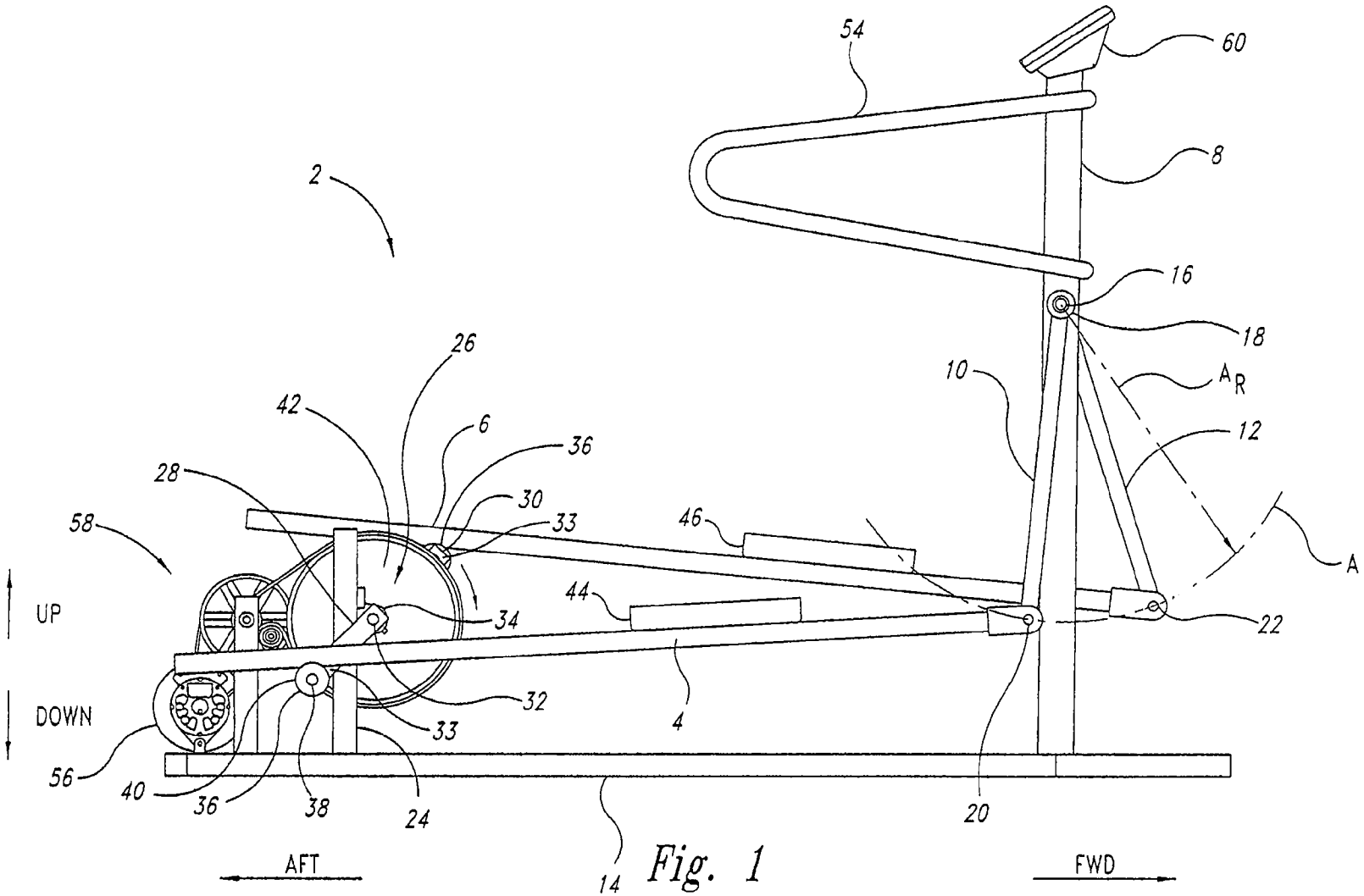
FIG. 1 illustrates one embodiment of the exercise device of the present invention, which includes two foot links pivotally suspended at a forward end from an upright pedestal by respective swing arms and rollably supported at a rearward end by rollers on crank arms, with a resistance device resisting the vertical component of the foot link motion via the rotating crank arms.

As shown in the drawings for purposes of illustration, the present invention is embodied in an exercise apparatus, indicated generally by reference numeral 2. The apparatus 2 primarily provides a lower body exercise while the user stands on the exercise apparatus and moves the user's legs and feet in a variety of pseudo-elliptical striding paths simulating the motion of running, jogging and walking, and the motion of stepping in place, all referred to herein as "striding" with varying amounts of stride horizontal length. The pseudo-elliptical striding paths have both height (vertical) and length (horizontal) components of movement. The exercise machine 2 accommodates a variety of stride lengths of the user and allows the user to change the length of stride while an exercise is in progress, without requiring any adjustment by the user of equipment settings. The exercise machine 2 allows an infinite variety of stride length throughout the exercise and, by virtue of the freedom of the mechanism, immediately adjusts in response to the changing stride length of the user. As used herein, stride length refers to the distance between rearward and forward end extents of travel of the user's foot during an exercise repetition.

Figure 12:
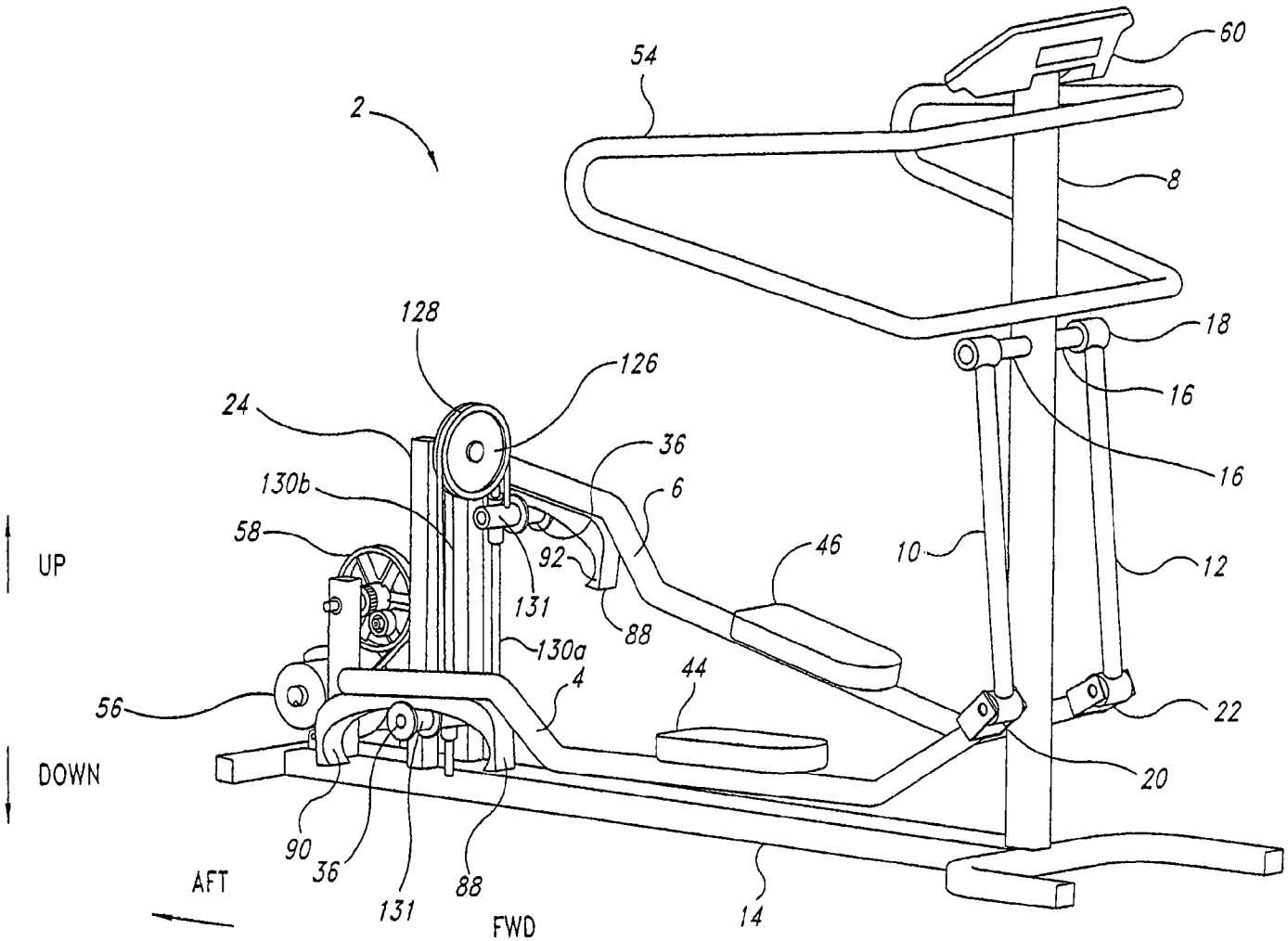
FIG. 12 illustrates a seventh alternative embodiment of the exercise device of the present invention using an alternative arrangement which provides the vertical component of the foot link motion at the aft ends of the two foot links.

In one embodiment shown in FIG. 12, the exercise machine 2 automatically and immediately moves in response to the stride height used by the user during the exercise and allows infinite user variability of the stride height throughout a large stride height range at any time during the exercise. As used herein, stride height refers to the distance between downward and upward end extents of travel of the user's foot during an exercise repetition.

The exercise machine 2 allows the user to vary the stride length independent of the stride height, thereby allowing the user to engage in a natural stride length which can be varied during the exercise without being constrained to a particular stride length and height selected by the manufacturer to be used by all users without variation. The exercise machine 2 in some embodiments has right and left foot dependency in the rearward and forward directions.

The result is an exercise apparatus with improved construction and user feel, and greater flexibility and ease of operation that can simulate all striding-type motions and be comfortably used by users with different natural stride lengths. The exercise machine 2 can simulate striding-type motions from running with large stride lengths to stepping in place with little or no stride length, with stride length movements that match the natural movements for a user of any size. The exercise machine 2 automatically follows the stride length input by the user while the exercise is in progress and automatically responds to any changes in stride length input by the user.

FIG. 1 illustrates one embodiment of the exercise machine 2 of the present invention. The exercise machine includes a right foot beam or link 4 and a left foot beam or link 6, laterally spaced-apart to comfortably receive a user's right and left feet, respectively, thereon for performing a striding movement. Right and left foot engagement pads 44 and 46 are provided on the right and left foot links 4 and 6, respectively, between the forward and rearward end portions of the foot links, to receive the right and left feet of the user with the user facing in the forward direction (FWD) indicated on FIG. 1. The right and left foot links 4 and 6 each have their forward end portion pivotally suspended from an upright forward support structure or pedestal 8 by respective laterally spaced-apart right and left swing arms 10 and 12. The pedestal 8 extends upward from a fixed position on a stationary base 14, which is configured to rest on a floor surface. Each of the swing arms 10 and 12 is pivotally suspended about a fixed pivot point on the upright pedestal 8, the right swing arm 10 being on the right side of the pedestal and the left swing arm 12 being on the left side of the pedestal, by a pivot pin or axle 16 projecting from the right and left sides of the pedestal 8. A bearing journal 18 formed at one end of each swing arm 10 and 12 is pivotally mounted on the corresponding free end of the axle 16, with a rotary bearing or bushing therebetween.

The swing arms 10 and 12 are elongated structures, each having the bearing journal 18 at an upper end, and a respective one of right and left pivotal foot link connections 20 and 22 at a lower end. The right and left pivotal foot link connections 20 and 22 each provide a pivot connected to the forward end portion of a respective one of the foot links 4 and 6. Pivotal connections 20 and 22 are devices attached to the foot link, with a pivot pin extending through the bearing journal, but can have any other suitable hinge or pivot configuration. The swing arms 10 and 12 are rigid links, such as metal tubes, rods, or plates. Optionally, the swing arms 10 and 12 can be formed from flexible links, for example, made of cables, chains, straps or another suitable flexible material.

The swing arms 10 and 12 guide the front end portions of foot links 4 and 6, at respective pivotal connections 20 and 22, in a pendulous swinging motion through an arcuate path "A" indicated on FIG. 1 about the axle 16, having a predetermined radius "AR." Travel along arcuate path "A" provides a substantially horizontal forward-rearward component of motion simulating that motion of the user's stride. While a small vertical component of motion results as the swing arms swing rearwardly and forwardly, the movement is primarily in the horizontal direction.

A pair of laterally spaced-apart upright stanchions 24 extend upward from the base 14 in a fixed, longitudinally spaced-apart relationship with the pedestal 8. The stanchions 24 rotatably support a bell crank assembly 26, which includes right and left crank arms 28 and 30 rigidly attached to opposite ends of a transverse axle 32. The crank arms 28 and 30 travel along identical repeating unidirectional circular paths, but 180 degrees out of phase with one another. The crank arms 28 and 30 are in fixed relationship to one another, spaced-apart on the opposite, laterally outward sides of the stanchions 24. The axle 32 is rotatably supported in a fixed location on the stanchions 24 for rotation about a transverse pivot axis by two rotary bearings or bushings 34, one secured to each of the stanchions 24.

Figure 8:
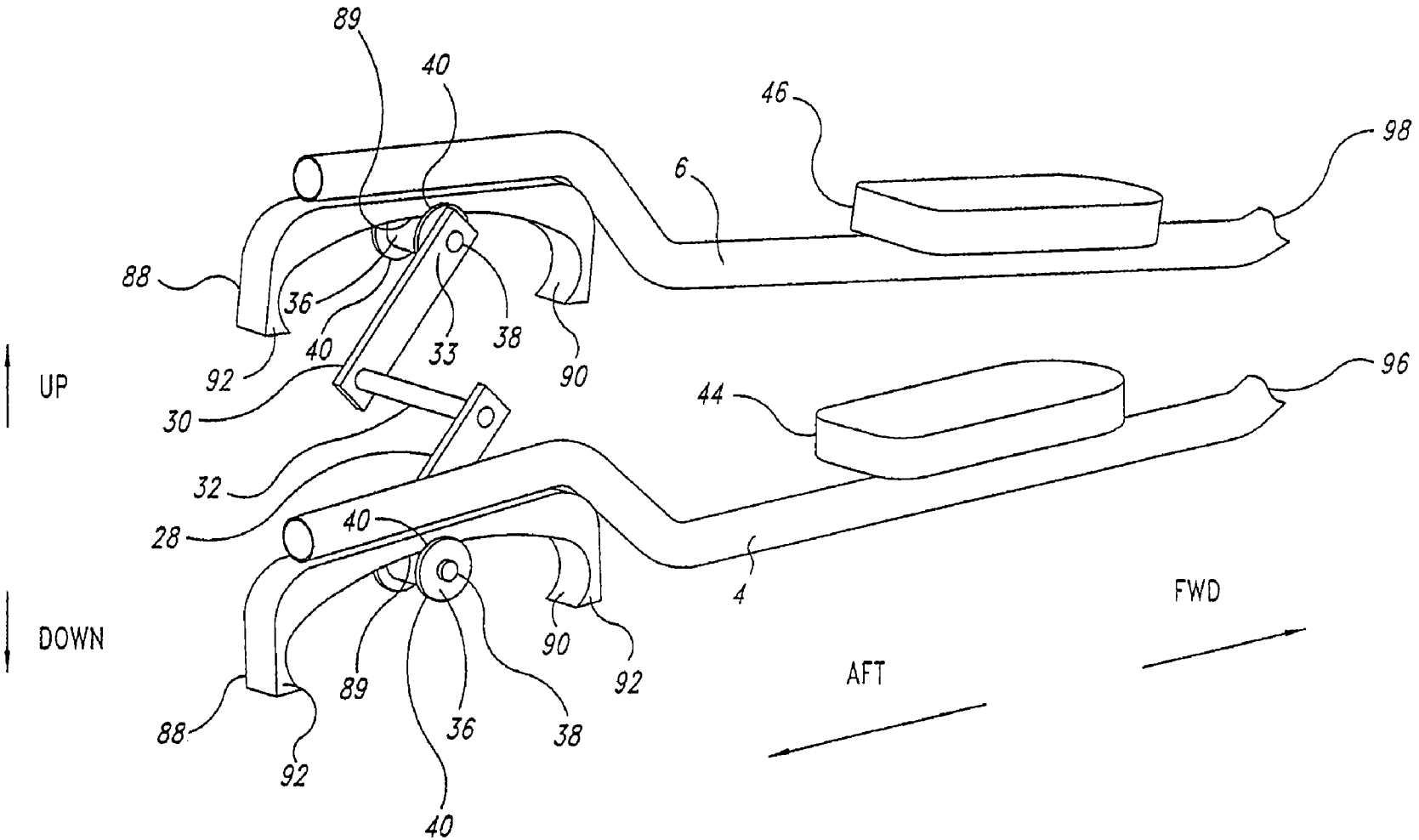
FIG. 8 is an enlarged perspective view of only the foot links, cams and crank arms used in the embodiments of FIGS. 4-7.

The rearward end portion of each of the foot links 4 and 6 is supported by a distal end 33 of a corresponding one of the crank arms 28 and 30, at a free end of the crank arm spaced apart from the axle 32 to move down and up with the crank arm. In the embodiment of the exercise machine 2 illustrated in FIG. 1, the rearward end portions of foot links 4 and 6 each rollingly rest atop a roller 36 rotatably mounted on a pin 38 attached to the distal end 33 of a corresponding one of the crank arms 28 and 30. The pins 38 extend laterally outward to the right and left sides of the crank arms 28 and 30, respectively, parallel with the axle 32. The rollers 36 of the crank arms 28 and 30 are shaped to laterally retain the foot links 4 and 6 thereon as the foot links reciprocally move freely rearward and forward relative to the rollers during use of the exercise machine 2. This arrangement allows the user to use a stride length during the exercise and change stride length without any machine adjustments while the exercise is in progress. As best seen in FIG. 8, the rollers 36 are spool shaped with inward and outward end walls 40 to retain the foot links therebetween. The rollers 36 are mounted on the pins 38 with rotary bearings or bushings (not shown) therebetween. The rollers 36 thereby combine with rotating crank arms 28 and 30 to allow rearward-forward movement of the foot links 4 and 6 as the crank arms rotate and move the foot links up and down. In alternative embodiments, the rollers 36 can be replaced with members that slidably support the foot links 4 and 6 thereon.

A pulley 42 is rotatably mounted to and between the stanchions 24 for rotation about the axle 32 and rotationally fixed relative to crank arms 28 and 30 to rotate therewith. The pulley 42 is rotatably attached to a transmission 58 containing a flywheel that has a sufficiently heavy perimeter weight and is indirectly coupled to crank arms 28 and 30 so as to help turn the crank arms smoothly even when the user momentarily is not supplying a turning force and promote a smooth reversal of foot link directions during the exercise.

As noted above, the foot engagement pads 44 and 46 are provided on the foot link members 4 and 6, respectively. Each of the foot engagement pads 44 and 46 is sized to receive the user's corresponding foot thereon during exercise. It is noted that alternatively the foot links 4 and 6 can be constructed without the foot engagement pads 44 and 46, with the user standing directly on the upper surface of the foot links.

The exercise machine 2 is operated when the user's right and left feet are placed in operative contact with the foot engagement pads 44 and 46, respectively. The user exercises by striding forwardly toward the pedestal 8. Each striding motion of the user's foot, while engaging one of the right and left foot engagement pads 44 and 46, pushes a corresponding one of the right or left foot link 4,6 rearward away from the pedestal 8. As the one foot link is pushed rearward by the user exercising, the other foot link 4,6 tends to be carried forward toward the pedestal by the combined force resulting from the crank arm supporting the other foot link rotating applying a forward force on the foot link, from the swing arms 10,12 supporting the foot link tending to pull the foot link forward as it seeks a position hanging straight downward, and from the user's other foot applying a forward force on the foot link as it is moved forward in preparation for the next stride. However, the user naturally keeps enough weight on the forward moving foot link that the forward moving foot link will be moved no farther or less forward than the user moves the foot on that foot link forward. Thus, the forward moving foot link moves forward with the foot thereon.

The operation of the exercise machine 2 can be started with the foot links 4 and 6 in any position. For example, with the exercise machine in the position illustrated in FIG. 1, the user's gravitational mass, i.e., weight, placed predominantly on the left foot engagement pad 46 of the left foot link 6 causes the left foot link 6 to sink downwardly toward base 14. The gravitational force resulting from the user's weight being predominantly on the left foot link 6 is transmitted to the left crank arm 30, thus causing the left crank arm 30 to rotate in the clockwise direction (as view from the right side of the exercise machine in FIG. 1) about the axle 32 as the left foot link 6 moves downwardly toward the base 14. A natural striding motion causes the user to initially primarily ride the left foot link 6 downward but to push rearwardly more with the left foot against the left foot engagement pad 46 as the user's left foot moves farther downward, much as the user would initially bring the foot into contact with the ground and then push backward against the ground while striding to propel the user forward. This movement on the exercise machine 2 moves the left foot link 6 rearward. The exercise machine 2 allows the user to determine the stride length that best suits him, and does not require the same foot path be followed by all users. As in a natural striding motion, as the left foot is moved rearward to propel the user forward, the user simultaneously moves the right foot forward which helps carry the right foot engagement pad 44 and the corresponding right foot link 4 therewith by an amount determined in the striding motion of the user, not the machine parameters. This simulates normal striding on the ground, where when one foot is put down and pushes rearward to move the striders body forward, the other foot is lifted and moved forward to get ready for the other foot's turn to be put down and push rearward.

Through the rotation of the crank arms 28 and 30 about the axle 32, the downward movement of the left foot link 6 and the resulting clockwise rotation of the left crank arm 30, causes the right crank arm 28 to rotate clockwise and move upward. The supporting engagement of the right crank arm 28 with the right foot link 4, through the roller 36 thereof, lifts the right foot link 4 upward away from base 14 as the left foot link 6 moves downward toward the base. The inertia of the transmission 58 as well as the continued downward and rearward pushing by the user's left foot on the left foot engagement pad 46, rotates the left crank arm 30 clockwise past its bottom dead center position pointing directly downward (i.e., the 6 o'clock position), where the left foot link 4 is at its lowest position, and rotates the right crank arm 28 clockwise past its top dead center position pointing directly upward (i.e., the 12 o'clock position), where the right foot link 6 is at its highest position.

While this describes the motion of the left foot link 6 downward and rearward, starting from the position shown in FIG. 1, exactly when the user actually stops pushing rearward on the left foot engagement pad 46 with the left foot and transfers his weight predominantly to the right foot and the now raised right foot link 4 in order to repeat the forward striding motion with the right foot link, depends on how long of a stride the user has decided to use for that moment of the exercise. The longer the stride, the later the weight shift will occur after the left crank arm 30 passes the bottom dead center position and begins to rise. It is noted that unlike prior art elliptical exercise machines, which have the forward-rearward movement of the right and left foot links precisely controlled by being fixedly attached to the crank arms, the right and left foot links 4 and 6 of the present invention move with the user's feet substantially forward and rearward relative to the rollers 36 of the right and left crank arms 28 and 30, generally independent of the rotational position of the crank arms. Thus, the rearward pushing movement of the user's left foot on the left foot engagement pad 46, and hence on the left foot link 6, for example, might be stopped even before the left crank arm 30 reaches the bottom dead center position for a short stride (for almost a stepping or jogging in place movement with very little forward-rearward travel of the foot links), or might be stopped after the left crank arm 30 is in a horizontal position pointing rearward but before reaching the top dead center position (for a long striding movement, especially for a user with long legs and a natural long stride).

When the user does stop pushing rearward with the left foot, the user's weight will be predominantly transferred to the right foot and thrust the right foot engagement pad 44 and the right foot link 4. When this occurs, the right crank arm 28 will have been rotated clockwise from the position shown in FIG. 1 to a position 180 degrees from the position of the left crank arm 30 when the user elects to transfer his weight. This might be at or about the top dead center position of the right crank arm 28 for a stepping or jogging in place movement with a very short forward-rearward travel of the foot links 4 and 6, or near or after a horizontal position where the right crank arm 28 is pointing forward for a long striding movement, or anywhere the right crank arm 28 is located when the weight transfer occurs. The weight transfer to the right foot engagement pad 44 and hence the right foot link 4 will normally occur for smooth operation when the right crank arm 28 is in a position where downward movement of the right foot link is still possible under the user's weight after the weight transfer occurs. Once the weight transfer occurs to the right foot link 4, the user continues the exercise movement, this time with the right foot moving downward and pushing rearward against the right foot engagement pad 44, while he simultaneous moves his left foot forward while the left foot engagement pad 46 and the left foot link 6 move forward with it. As with the left foot, the natural striding movement of the right foot is to initially primarily ride the right foot link 4 downward but to push rearwardly as the user's right foot moves farther downward. By the time the crank arm supporting the foot link to which the user's weight is transferred nears the bottom dead center (6 o'clock) position, the foot is applying an increasingly horizontal rearward pushing force to the foot link. As described for the left foot, the user at the time he selects will shift his weight back to the left foot engagement pad 46 and a full cycle with both left and right foot forward strides will be completed. By continuing to cyclically move the left and right feet as described, a natural striding movement is achieved which can have a very different stride length and path for each user and can be changed in response to the user changing his stride length during the exercise.

As noted, the actions of the two interconnected crank arms 28 and 30 are exchanged, usually some time after the opposite crank arm moves clockwise past the 12 o'clock position and starts rotating downwardly toward base 14. The user's, weight is then transferred to the now sinking foot link supported by this crank arm. The crank arm rotation causes the foot link supported by the other crank arm to rise upwardly away from base 14. When the foot link supported by this other crank arm reaches the position where the user decides to transfer his weight thereto, the process starts over with respect to the now newly weighted foot link. The now substantially unweighted foot link is moved forward, as described above in part by the movement of the crank arm supporting it and by the forward moving foot of the user in a natural striding motion. It is noted that the forces are transferred to the foot links 4 and 6 via the foot engagement pads 44 and 46, in the illustrated embodiment of FIG. 1, but may be through any other suitable force transference mechanism affixed to the respective foot links, or directly to the foot links.

When the motion of the foot links 4 and 6 occurs, as described above, the forward end portion of each foot link also moves, but with a very different motion. Each time one of the foot links 4 and 6 moves forwardly toward the pedestal 8 or rearwardly away from the pedestal, the forward end portion of the foot link experiences a swinging motion forward or rearward by its connection to a corresponding one of the swing arms 10 and 12. As a result, the forward end portions of the foot links 4 and 6 travel along the arcuate path "A" shown in FIG. 1. This arcuate motion of the forward end portions of the foot links 4 and 6 primarily involves forward and rearward travel of the forward end portions of foot links as the swing arms 10 and 12 pivot, but a small up and down movement of the forward end portions of the foot links also results.

Each user stride thus moves one of the foot links 4 and 6 rearward and the other is moved forward to position it for the next stride. The shifting of the user's weight between the foot links 4 and 6 causes the interconnected crank arms 28 and 30 to responsively rotate clockwise, and alternately moves the foot links downward toward and upward from the base 14, with the movements of the foot links being 180 degrees out of phase with one another. The resulting combined downward and upward motions of the foot links as the crank arms 28 and 30 rotate, and the rearward and forward movement of the foot links, result in the movement of the foot engagement pads 44 and 46 of the foot links 4 and 6 in a cyclical pseudo-elliptical motion path with the actual path shape dependent on how the user chooses to perform his striding exercise.

A handle bar 54 is provided at a predetermined height above the foot links 4 and 6 to assist the user in keeping his balance during operation of the exercise machine 2.

As noted, the interaction of the crank arms 28 and 30 with the transmission 58 which supplies inertia, tends to smooth the user's striding motion. A resistance device 56 can be utilized if desired to allow the user to selectively increase the effort required by the user to perform a striding motion exercise while on the foot links 4 and 6 and hence control the user energy required for the exercise. In the embodiment of the invention illustrated in FIG. 1, the resistance device 56 is positioned on the base 14 at the rear of the exercise machine 2 adjacent to the stanchions 24. The resistance device 56 is coupled to the crank arms 28 and 30 through a series of pulleys and belts forming the mechanical transmission 58. The transmission 58 may be deleted if not needed, or formed from any suitable arrangement of belts and pulleys, chains and gears, interconnected shafts, or other mechanisms to transmit the rotational energy of the crank arms 28 and 30 to the resistance device 56 and thereby resist the rotation of the crank arms 28 and 30 with a user selected degree of resistance preferred.

The exercise machine 2 may be alternatively fitted with any one of a variety of known brake mechanisms, or even operated without a brake. In the embodiment of the invention illustrated in FIG. 1, the resistance device 56 is an electrical alternator. Other alternative resistance devices include conventional magnetic resistance brakes operating on the eddy current principle, friction brakes such as using frictional contact with the flywheel 42, other brakes such as air resistance fan brakes and hydrodynamic, i.e., fluid resistance brakes, and other suitable resistance devices. Other alternative embodiments of the exercise machine 2 are described subsequently herein using other braking configurations.

An electrical control panel 60 is mounted on the exercise machine 2, atop the pedestal 8. The control panel 60 is electrically coupled to control operation of the resistance device 56, thereby providing remote adjustment thereof, that is accessible to the user during the exercise. The control panel 60 also provides other exercise related information as is conventional with exercise equipment.

In contrast to prior art exercise devices, the exercise machine 2 of the present invention provides a variable stride length that is dynamically user adjustable while an exercise is in progress without changing any machine settings, and without the machine changing its own settings, by the simple act of the user stretching the user leg movement into a longer stride or shortening the leg movement into a shorter stride (or stepping motion). Furthermore, the exercise machine 2 is infinitely adjustable within the physical limitations of the machine, and is therefore naturally variable to complement the different natural stride lengths of taller and shorter users, and even the different stride lengths of users with the same height, and even the different stride lengths a user wishes to use during the course of an exercise. The exercise machine 2 produces a pseudo-elliptical stride path that is infinitely variable in response to the user input through the movement of his feet when performing an exercise.

As noted above, the rearward and forward motion of the foot links 4 and 6 is responsive to the left and right rearward and forward feet movements of the user, and operates substantially independent of the vertically reciprocating motion of the foot links produced by the rotation of the crank arms 28 and 30. For purposes of more clearly illustrating the construction and operation of the exercise machine 2, it is noted that if the user's weight was evenly balanced between foot engagement pads 44 and 46, the respective foot links 4 and 6 would be in parallel arrangement, each positioned at the same distance above the base 14. The crank arms 28 and 30 would be rotated to the 3 o'clock and 9 o'clock positions, halfway between the top dead center and bottom dead center positions (i.e., the 6 o'clock and 12 o'clock positions). If the user's weight could remain so balanced between the foot engagement pads 44 and 46, a user's striding motion would move one of the foot links 4 and 6 rearwardly away from pedestal 8 and the other forward toward the pedestal, each foot link being rollingly supported on a respective one of the rollers 36 mounted at the free distal end 33 of one of the crank arms 28 and 30. The distance of the foot links above the base 14 would not change. While not practical, and more like a shuffle than a stride, this exercise presents a useful illustration. As can be understood, the forward-rearward motion of the foot engagement pads 44 and 46, and hence the foot links 4 and 6, is independent of any downward-upward motion of the foot links produced by rotation of the crank arms 28 and 30, and of the downward and upward motion of the user's feet that does occur during a normal exercise.

Still assuming that the user's weight remains equally balanced between the foot engagement pads 44 and 46, it can be understood that while exercising the stride length of the user's feet and hence the rearward-forward movement of the foot engagement pads is adjustable between a minimum of no-length and the maximum motion of the foot links 4 and 6 defined by the physical parameters of exercise machine 2 as manufactured. While there is always a maximum stride length defined by the physical parameters of a particular configuration for the manufactured exercise machine 2, the exercise machine is preferably configured to accommodate even the longest stride of the tallest intended user.

It is noted that as the user applies a rearwardly pushing foot motion to one of foot engagement pads 44 and 46, and simultaneously the other of foot engagement pads 44 and 46 moves forward, each of the foot links 4 and 6 have their forward ends displaced along the arcuate path "A," via the pivotal connection of the foot links to the swing arms 10 and 12 described above. As the length of the stride is increased, the displacement of foot links 4 and 6 on respective swing arms 10 and 12 forces the forward ends of the foot links farther rearwardly and forwardly of the pedestal 8 along the arcuate path "A," which tends to progressively lift the forward ends upwardly farther away from base 14. The longer the stride, the more lifting that must occur.

Figure 9:
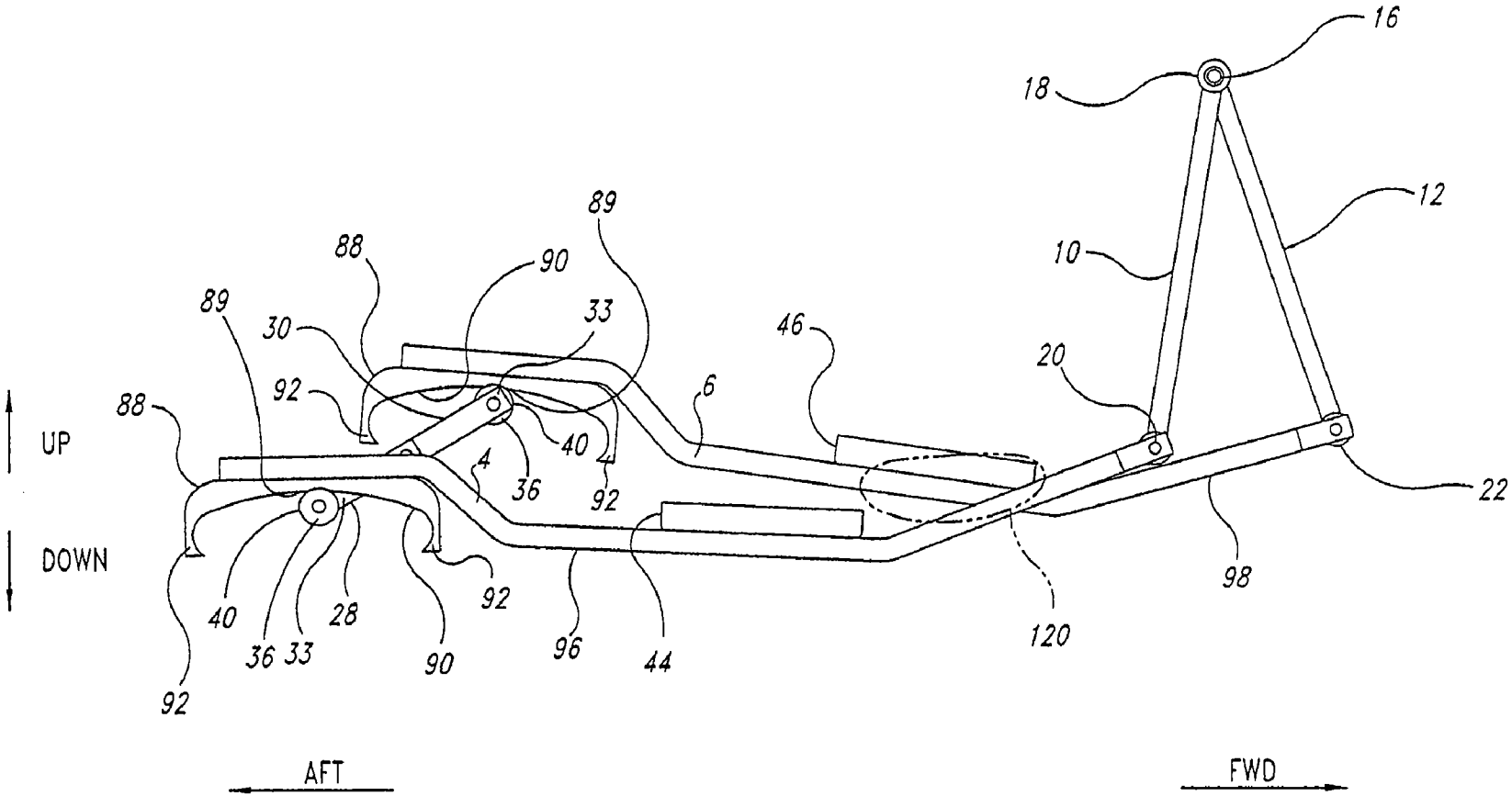
FIG. 9 illustrates a path followed by a user using a stride length corresponding to the combined lengths of the crank arms for the embodiments of FIGS. 4-7.
Figure 10:
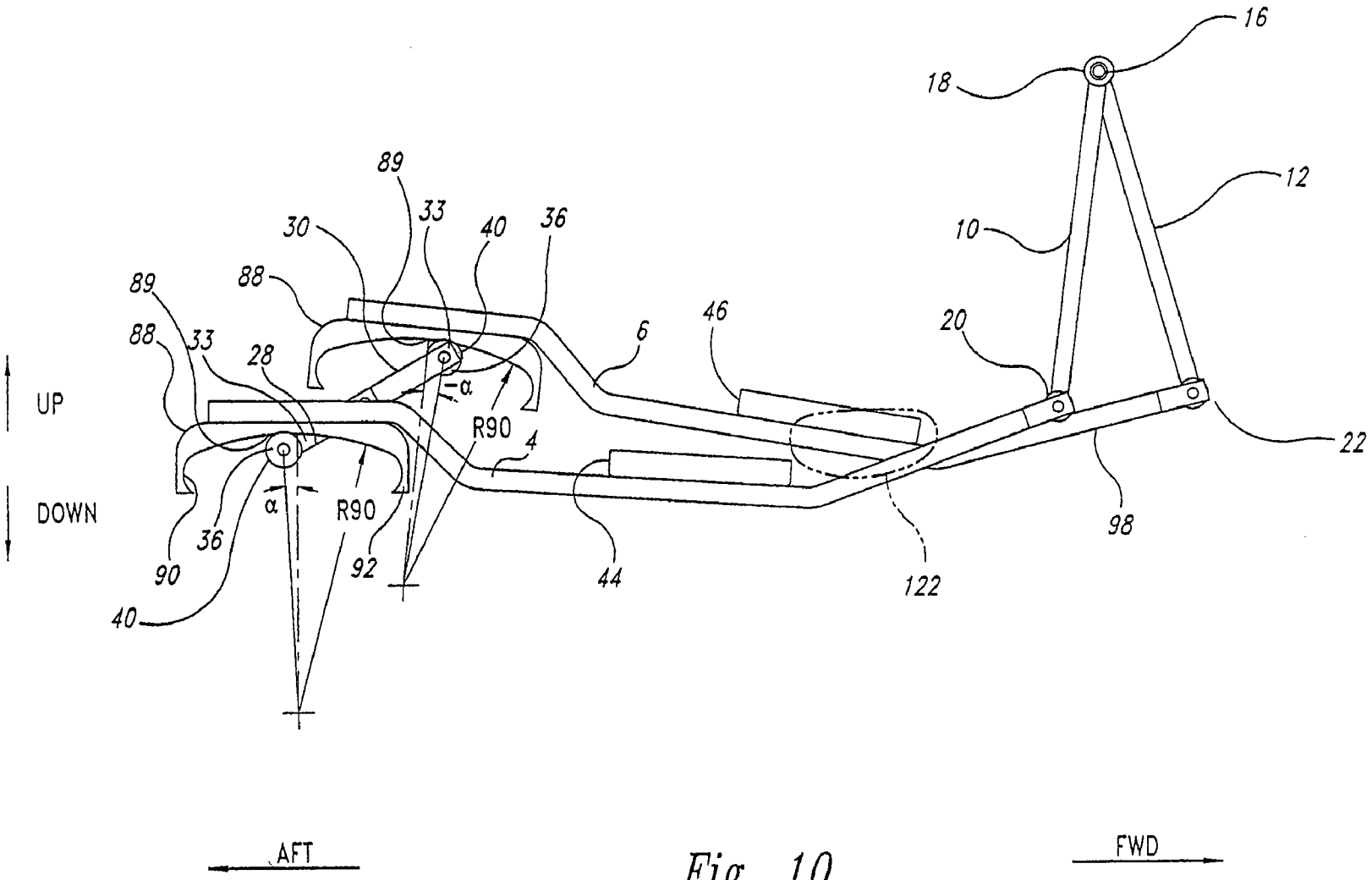
FIG. 10 illustrates a path followed by a user inputting a shorter stride length into the foot engagement pads on the two foot links of the embodiments of FIGS. 4-7.
Figure 11:
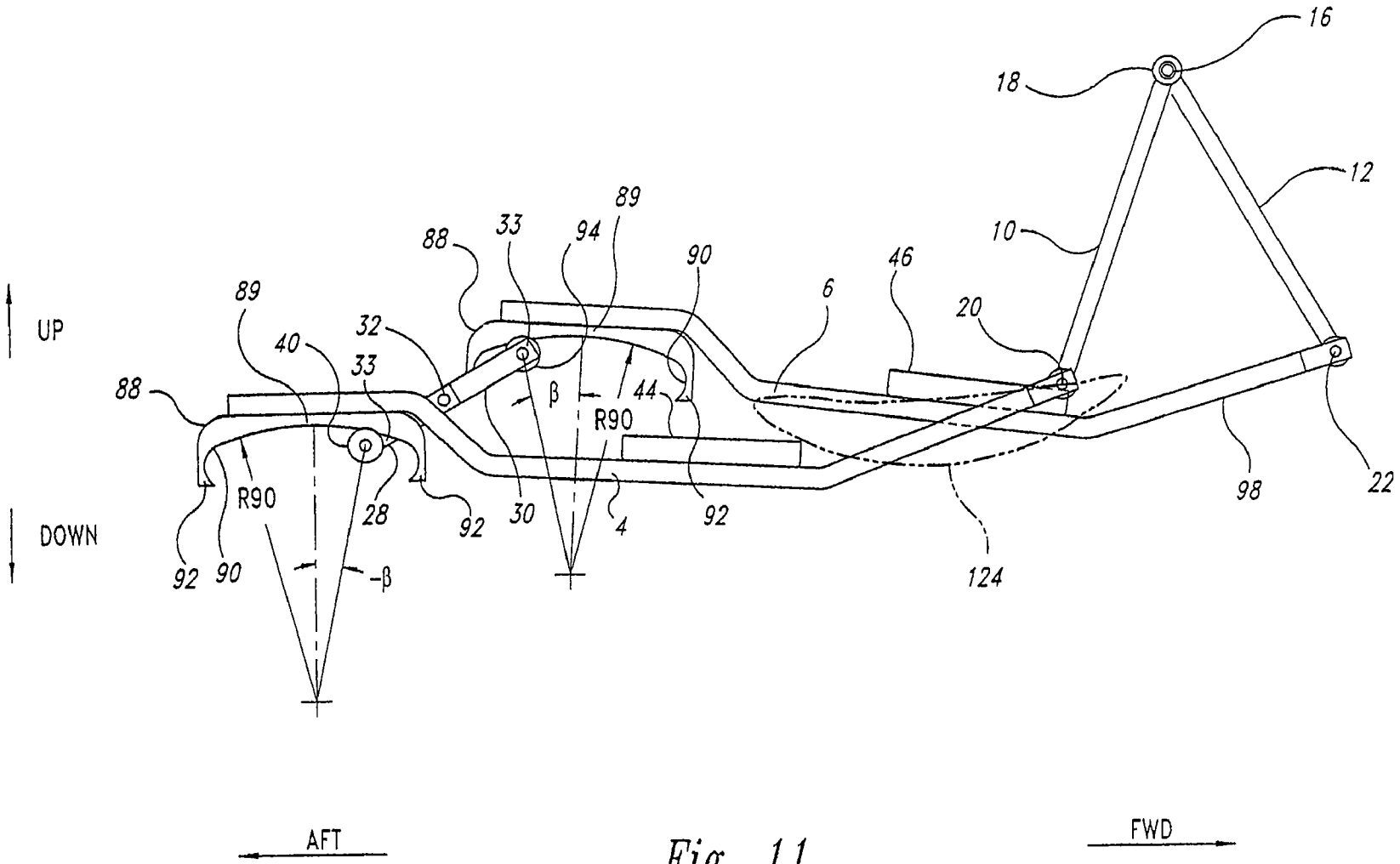
FIG. 11 illustrates a path followed by a user inputting a longer stride length into the foot engagement pads on the two foot links of the embodiments of FIGS. 4-7.

The user's striding movement when engaging the foot engagement pads 44 and 46 inputs energy to the exercise machine 2 which causes the rearward-forward movement of the foot links 4 and 6, the angular displacement of swing arms 10 and 12, and the rotation of the crank arms 28 and 30 and the flywheel 42. As described above, during an exercise using the exercise machine 2, the user inputs energy to the machine by performing a repetitive left-right striding motion, with the user selected striding length, which may be changed in length by the user at any time during the exercise. The resulting rearward and forward movement of the foot links 4 and 6 combines with the downward and upward movement of the foot links resulting from the rotation of the crank arms 28 and 30, to produce a pseudo-elliptical stride path for the feet of the user to follow at each of the respective foot engagement pads 44 and 46. The pseudo-elliptical stride path is illustrated for an alternative embodiment of the exercise machine 2 in FIGS. 9-11 showing three different user varied stride lengths, and will be described in greater detail below. As noted, the forward ends of the foot links 4 and 6 each has a swinging arcuate motion which also impacts the shape of the pseudo-elliptical stride path produced. The longer the length of the swing arms 10 and 12 used for the exercise machine, the flatter the pseudo-elliptical stride path that results.

In the illustrated embodiments of the exercise machine 2, the length of the crank arms 28 and 30 is sized at about one-half the normal stride length of adult persons at the lower end of the range of normal stride lengths when exercising. That is, the combined lengths of the diametrically opposed crank arms 28 and 30 is approximately a normal short stride length. In the illustrated embodiment, the crank arms are each 7.5 inches in length, for a combined length of 15 inches. The length of the foot links 4 and 6 is sized to be long enough to accommodate even much longer normal stride lengths without the rearward ends thereof being moved forward past the rollers 36 on which supported as the foot links move through their pseudo-elliptical stride paths. As already discussed, throughout the exercise, the foot links 4 and 6 are maintained in rolling engagement with the rollers 36 rotatably mounted on the distal ends 33 of the crank arms 28 and 30, and are free to move rearward and forward relative to the rollers, as required to respond to the length of the stride of the user.

It is to be recognized that if the user selects a stride length that closely matches the combined lengths of the crank arms 28 and 30, and also moves his feet throughout the pseudo-elliptical stride path coincident with the forward and rearward movement of the rollers 36 as the crank arms rotate about the axle 32, there would be no rearward-forward movement of the foot links relative to the rollers. In the event that the rearward-forward foot movement of the user's feet and hence the foot links 4 and 6 does not match the rearward-forward movement of the respective roller 36, relative rearward-forward movement occurs between each foot link and the roller supporting it. The amount and timing of this relative rearward-forward movement affects the shape of the pseudo-elliptical stride path experienced during the exercise. A shorter stride tends to produce a more circular or ovate path than the longer, flatter path produced by a longer stride. A stepping or jogging in place movement produces a generally vertically oriented path with little or no rearward-forward separation between the up and down halves of the path.

It is noted that while a forward striding exercise movement by the user has been described, the user can also exercise on the exercise machine 2 by performing a rearward striding movement (i.e., running backwards while still facing forward toward the pedestal 8). The user need only apply his weight to the appropriate foot link to cause the initial rotational movement of the crank arms 28 and 30 to be counterclockwise as viewed from the right side in FIG. 1. The shifting of the user's weight between the foot links occurs in the reverse of what has previously been described for forward striding.

It is noted that the shape of the pseudo-elliptical stride path can also be affected by the size components selected when manufacturing the exercise machine 2, for example by selecting shorter or longer crank arms 28 and 30, or swing arms 10 and 12. Additionally, changes in design can be made to select different placement of the pivotal foot link connections 20 and 22 along the length of the swing arms.

Figure 2:
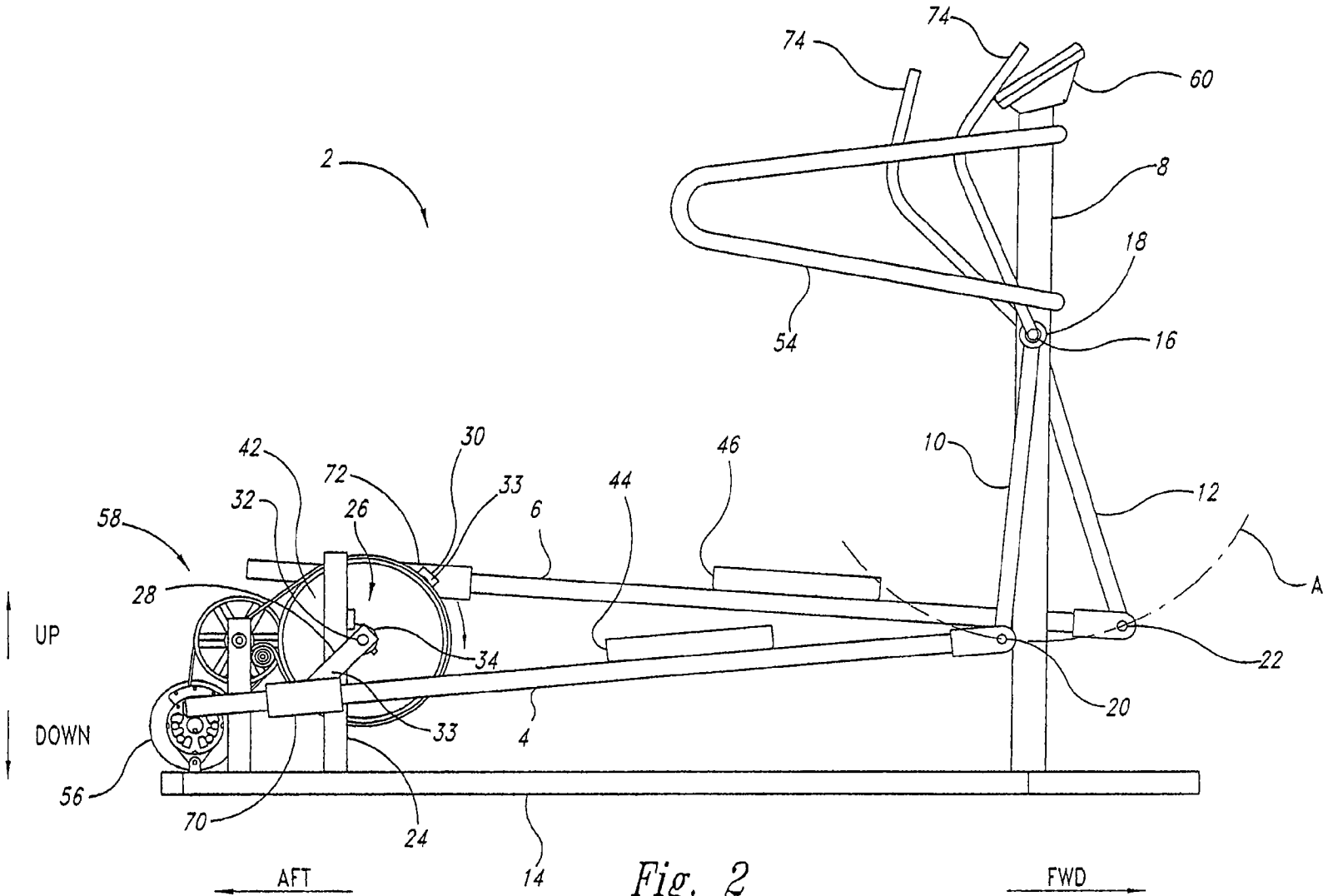
FIG. 2 illustrates a first alternative embodiment of the exercise device of the present invention, wherein the two foot links are slidingly supported at the rearward end by linear bearings attached to the crank arms and handles are fixed to the swing arms for upper body exercise.

A first alternative embodiment of the exercise machine 2 is illustrated in FIG. 2, wherein the right and left foot links 4 and 6 are rollingly engaged with respective crank arms 28 and 30 using linear bearings 70 and 72, respectively. In the embodiment illustrated in FIG. 2, at least the rearward end portions of the foot links 4 and 6 are formed with tubular or cylindrical shapes and extend through a respective one of the linear bearing 70 and 72. Such linear bearings 70 and 72 are well-known in the related arts and are often formed of a sleeve with internal channels for lubricated ball bearings. The linear bearings 70 and 72 present an alternative to use of the rollers 36 (shown in the embodiment of FIG. 1), but as with the rollers, the linear bearings permit the unrestricted rearward-forward movement of the foot links 4 and 6 relative to the linear bearings while independently transmitting the downward-upward forces between the foot links and the crank arms 28 and 30. Each of the linear bearings 70 and 72 is rotatable attached to the distal end 33 of a corresponding one of the crank arms 28 and 30. While the linear bearings are used instead of the rollers 36, the exercise machine 2 illustrated in FIG. 2 generally operates the same as the embodiment illustrated in FIG. 1.

The linear bearings 70 and 72 may alternatively have other bearing constructions, such as being lined with a low-friction material, such as Teflon®. or Nylon, formed with a cylindrical channel sized to slidingly receive the rearward end portions of the foot links 4 and 6 or use roller bearings. Other forms of reduced friction engagement can also be used or the foot links can simply slidably rest upon a pin or other engagement member attached to the crank arms 28 and 30.

The embodiment of FIG. 2 includes a pair of lever arms 74, each mechanically coupled to a corresponding one of the swing arms 10 and 12. The lever arms 74 extend from the respective swing arms 10 and 12 upwardly into the hand gripping range of the average user of the exercise machine 2, and form rigid mechanical extensions of the swing arms 10 and 12 joined thereto at or about the eye 18 of the swing arms. The lever arms 74 rotate about the axle 16 of the swing arm to which connected and rotate with the swing arm. In operation, the user of the exercise machine 2 grips one of lever arms 74 in each of his left and right hands, and pulls or pushes on the lever arms 74 in coordination with the rearwardly and forwardly movement of the foot links 4 and 6, respectively. An upper body exercise is thereby accomplished with the lower body exercise provided by the user striding to move the foot links 4 and 6.

Figure 3:
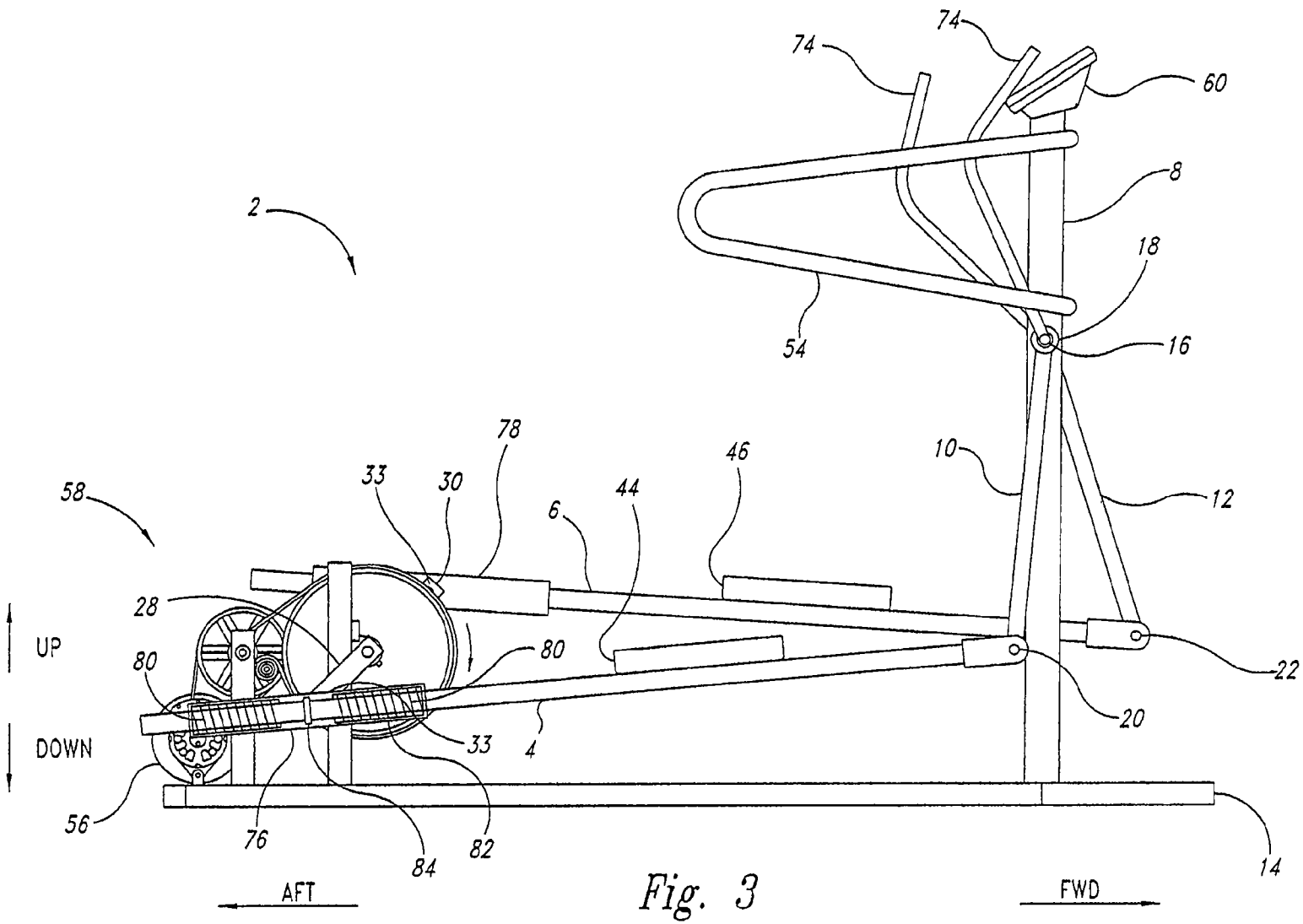
FIG. 3 illustrates a second alternative embodiment of the exercise device of the present invention similar to the embodiment of FIG. 2, wherein the linear bearings have springs that tend to limit the fore-aft displacement of foot link while easing the jolts that may otherwise accompany reversal of directions.

A second alternative embodiment of the exercise machine 2 is illustrated in FIG. 3 which is very similar to the embodiment of FIG. 2. In the FIG. 3 embodiment, linear bearings 76 and 78 are used with springs that tend to limit the rearward-forward displacement of foot links 4 and 6 relative to the distal ends 33 of the respective crank arms 28 and 30, while cushioning the jolts that would otherwise occur when hitting a fixed stop member prior to reversal of the direction of foot link rearward-forward movement. Each of the linear bearings 76 and 78 uses spaced-apart rearward and forward compression springs 80 captured against rearward and forward motion, respectively, by the closed rearward and forward ends of a bearing housing 82. The rearward end portion of a corresponding one of the foot links 4 and 6 extend through the bearing housing and through the rearward and forward springs 80 therein. Each of the foot links 4 and 6 has a stop 84 rigidly attached thereto, and positioned and sized to engage the inward ends of the springs if the foot link moves rearwardly or forwardly more than a fixed amount relative to the linear bearing. The two springs 80 in each linear bearings 76 and 78 are spaced apart far enough, and compress sufficiently during operation of the exercise machine as to not unduly limit the largest length of stride permitted for the users when using naturally long strides. When the user does stride with a long enough stride to cause the stops 84 of the foot links 4 and 6 to engage the inward ends of the springs 80, the shock load on the legs of the user that might otherwise occur with a fixed stop is absorbed by the springs 80. This results in an exercise gentler on the legs and especially the knees of the user.

When the foot links 4 and 6 are moved sufficiently to engage the stop 84 thereof with one of springs 80, the user's continued foot movement in the same direction starts to compress the spring 80 engaged. The user starts to experience resistance once this contact is made between the stop 84 and the spring 80. The resistance increases as a function of the compression of spring 80. The amount of resistance and the rate at which it is applied are functions of the specific spring design. The increased resistance serves as a subtle reminder to the user to shift his weight and change direction of his feet movement. If this does not occur, eventually the effort required of the user to further compress the spring 8 to lengthen his stride becomes so great that no further lengthening of the stride is possible and the user shifts his weight and changes his foot movement direction to begin another stride. As noted, this is accomplished with the springs 80 serving as shock absorbers to relieve the jolts that could accompany the reversal of direction of the foot links 4 and 6 if fixed stops were used. Other resistance devices may also be used to provide increasing resistance to continued movement of the foot links 4 and 6 relative to the distal ends 33 of respective crank arms 28 and 30. For example, the compression springs 80 may be replaced with pneumatic or hydraulic springs or dampers, all generally well known in the applicable arts.

Figures 4, 4A:
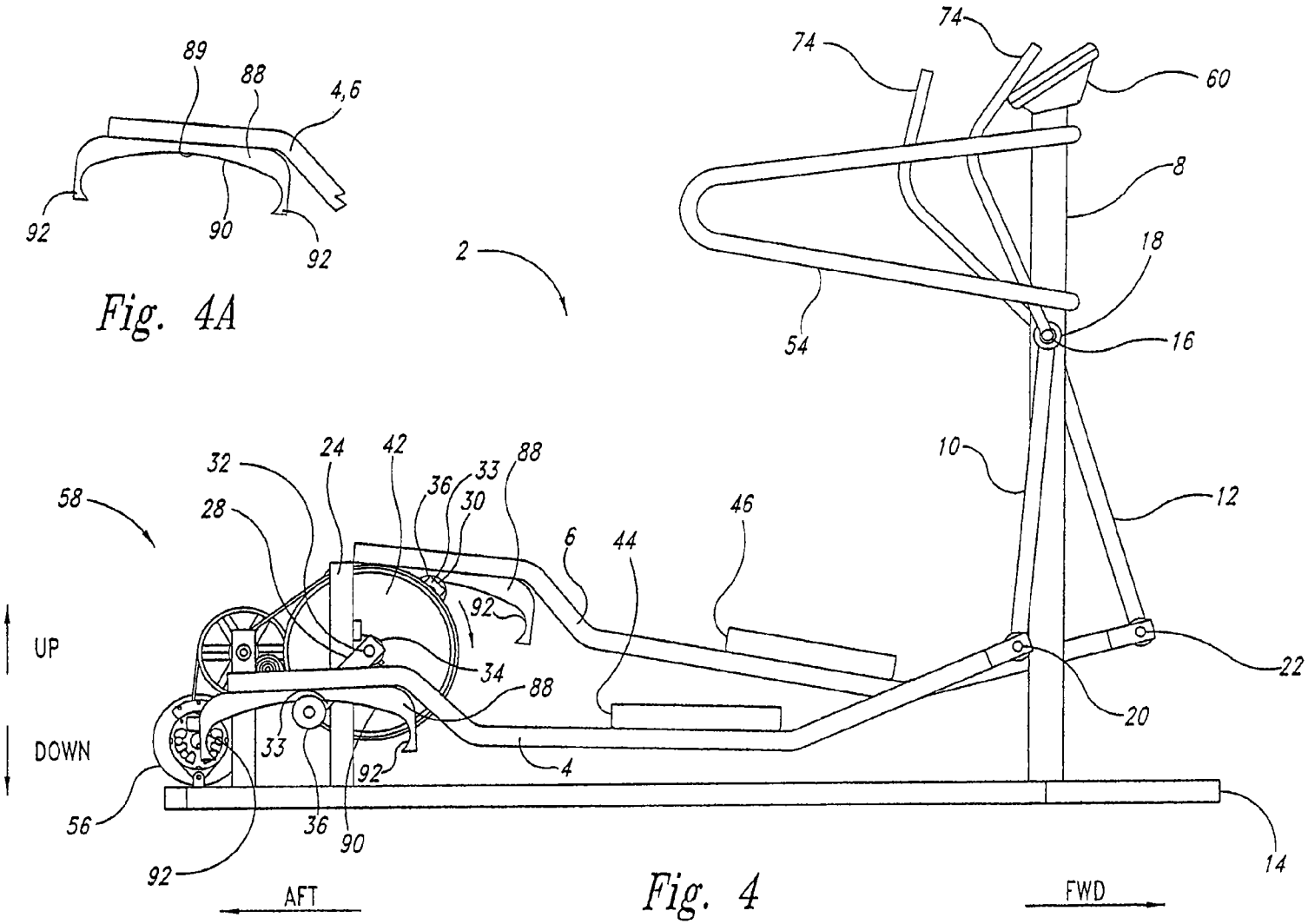
FIG. 4, illustrates a third alternative embodiment of the exercise device of the present invention, wherein forward and rearward cams at the rearward end of each foot link provide increasing resistance to the horizontal component of foot link motion when the foot links are moved horizontally relative to a central location between the cams.
FIG. 4A is an enlarged side view of cams used for the foot links for the embodiment of FIG. 4.

A third alternative embodiment of the exercise machine 2 is shown in FIG. 4. In this embodiment a different arrangement is used to limit the rearward-forward displacement of the foot links 4 and 6 while still providing increasing resistance to continued rearward-forward motion of the foot links 4 and 6 relative to the rollers 36 mounted on the distal ends 33 of the crank arms 28 and 30 as they reach a maximum limit established by the machine's configuration. In particular, a cam 88 is formed on or secured to the rearward end portion of each of the foot links 4 and 6 and configured to cooperate with a corresponding one of the rollers 36. The cams 88 each include a downward facing cam surface 90 extending between downwardly projecting forward and rearward stops 92. The surface 90 is rollingly engaged by the roller 36 and provides the surface along which the roller rolls during an exercise as the foot links 4 and 6 are moved rearwardly and forwardly relative to the roller, as described above for the embodiment of FIG. 1. The cam 88 is shown without the roller 3 and the other components of the exercise machine 2 in FIG. 4A. As can best be seen in FIG. 4A, the surface 90 has a central portion 89 located about midway between the forward and rearward stops 92. The surface 90 curves downward as it extends forward and rearward of the central portion 89, such that the central portion forms a laterally extending trough or peaked area of the surface in which the roller 36 tends to rest when the exercise machine is not in use and during at least some portions of an exercise using the exercise machine. The curvature of the surface 90 is relatively flat as it initially extends forward and rearward of the central portion 89 with a radius of curvature much greater than the radius of the roller 36 which engages the surface 90. The surface 90 progressively increases in curvature (i.e., the radius of curvature decreases) as it extends closer to the forward and rearward stops 92, whereat the surface 90 has a radius of curvature slightly larger than the radius of the roller 36.

FIG. 8 illustrates the crank arms 28 and 30 and their interaction with the cams 88 attached to the foot links 4 and 6. In FIG. 8, other components of the exercise machine 2 are not illustrated for purposes of clarity.

If the roller 36 is not already located at the central portion 89 of the surface 90, it will be forward or rearward thereof and when the user steps onto the foot engagement pads 44 and 46 of the foot links 4 and 6, the weight of the user will cause the foot link to move forward or rearward as necessary for the roller 36 rollingly engaging the cam 88 of the foot link to move to the central portion 89 of the surface 90. In general, this will occur even before the user steps onto the foot links as a result of the weight of the foot links themselves. The roller 36 tends to seek the peaked central portion 89 of the surface 90 since the surface rearward and forward thereof essentially is a downwardly ramping surface in both directions away from the central portion 89. The roller 36 not only tends to roll to this peaked central portion 89 of the surface 90, but even tends to stay there during an exercise unless the user applies enough rearward or forward force to the respective foot engagement pad 44, 46 to move the roller rearward or forward along the surface 90.

Moving the roller 36 away from the peaked central portion 89 along the ramped surface 90 requires energy (essentially like rolling the roller up an upwardly ramping surface). The curvature of the surface 90 as it extends away from the central portion 89 is selected so that during normal exercise when using an extended stride length, or as will be described, a reduced stride length, it is initially relatively easy to move the foot links 4 and 6 rearward and forward relative to the rollers 36, but that the energy the user must apply to do so progressively increases as the foot links move farther rearward or forward away from the central portion 89. The radius of curvature of the surface 90 in a central range extending about halfway forward from the peaked central portion 89 and about halfway rearward from the peaked central portion is selected to be sufficiently large relative to the roller 36 so that movement of the foot links 4 and 6 relative to the roller over this central range occurs easily with little horizontal resistance noticeable to the user while exercising. The length of this central range accommodates the length of most users normal strides as they normally vary during exercise. While the horizontal resistance experienced by the user over this central range when moving the foot link rearward or forward relative to the roller 36 from the peaked central portion 89 is initially almost imperceptible, it does gradually increase along this central range, and when moving rearward or forward beyond this central range, the horizontal resistance becomes appreciably more noticeable to the user and the rate of change in resistance increases.

Figure 17:
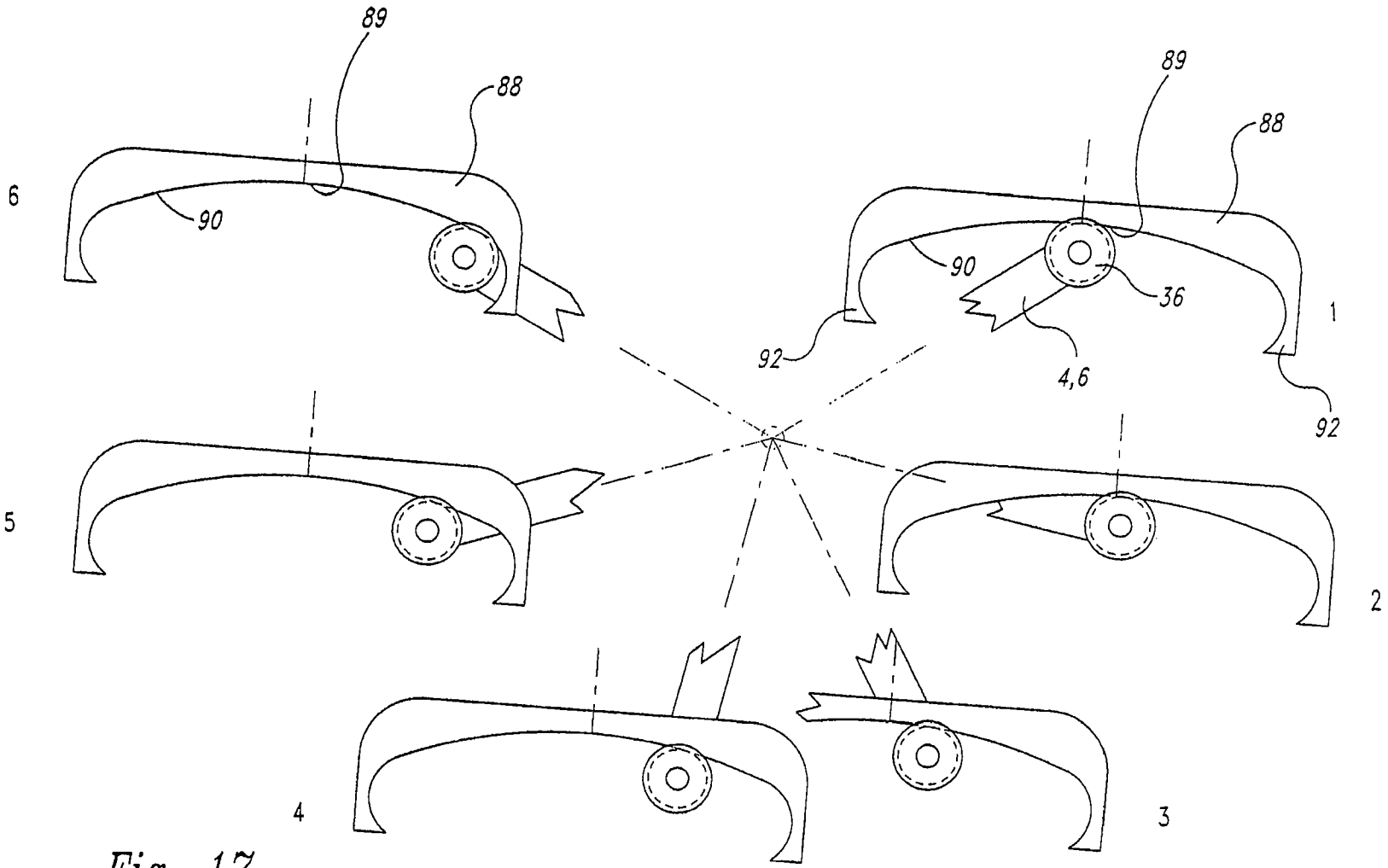
FIG. 17 illustrates a series of positions for one foot link by showing the various positions of a cam as the user moves the foot link through a stride.

A user striding with an unusually long stride will tend to move the foot links 4 and 6 beyond the central range. When the roller 36 approaches the stops 92, the curvature of the surface 90 transitions quickly to a radius of curvature closer to the radius of the roller 36 to prevent further movement beyond the stop. A typical complete cycle of one of the foot links 4 and 6 for a long stride length is illustrated in FIG. 17, showing only the cam 88 as it moves through 6 positions relative to the roller 36 supporting it. Position No. 1 corresponds to the position of the foot link 6 in FIG. 4 when the user first mounts the exercise machine 2 with the foot links happening to be positioned as shown. The more normal cyclic striding motion with the rearward moving foot of the user pushing rearward occurs between Position Nos. 2-6. At or about Position No. 6, depending on the length of stride being used, the user would shift his weight to the opposite foot on the other foot link and begin the rearward pushing movement with the opposite foot, generally repeating for that foot link the rearward movement from Position No. 2 through Position No. 6. It is noted that in Position No. 6 the roller 36 is nearing the forward stop 92, hence indicating a relatively long stride has been used by the user of the exercise machine.

The increasing difficulty realized by the user when the roller 36 rolls along the surface 90 toward the forward stop 92 is especially great since it is reached at the end of the user's rearward pushing stride, with the foot link still supporting most of the user's weight, as will be described more below. Similarly, when the roller 36 supporting the forward moving foot link approaches the rearward stop 92, the user is nearing the end of the forward movement of the foot before the user shifts his weight to this now forward foot. When the legs of the user are reaching the end positions of a striding movement, not only has the resistance significantly increased as a result of the decreased radius of curvature of the surface 90 compared to the central range, but it also becomes harder for the user to apply as much energy as at an earlier time in the stride when the legs are not stretched out so far. The length and curvature of the surface 90 rearward and forward of the central portion 89 are selected so that rarely will a user be able to or desire to apply enough force to cause the roller 36 to actually reach the stops 92 whereat no further movement therebeyond is possible. This avoids slamming into the stops 92 at the end limits of a stride and experiencing a shock load.

A striding motion applied by the user to the foot engagement pads 44 and 46 normally drives the respective foot links 4 and 6 rearwardly and forwardly relative to the rollers 36. However, if the forces applied by the legs of the user are not sufficient to move the foot links 4 and 6 rearwardly and forwardly relative to the rollers 36, the rollers maintain their position nested in the peaked central portion 89 of the surface 90 and the foot links move with the crank arms 28 and 30, both in the rearward-forward direction and in the downward-upward direction. In such case, the stride length experienced would be twice the length of the cam arms 28 and 30.

Should the user apply more force via his legs to the foot engagement pads 44 and 46 to lengthen his stride, one of the foot links 4 and 6 is moved rearward relative to the roller 36 engaging the cam 88 of that foot link and the roller rolls forward along the surface 90 toward the forward stop 92 thereof The amount of force applied with a rearward-horizontal component determines how far forward the roller 36 moves since increasing energy is required as the roller moves forward along the downwardly curving surface 90 since it results in lifting the body weight of the user on the foot link. The amount of lifting required is determined by the curvature of the surface 90 along which the roller is rolling. The smaller the radius of curvature, the greater the amount of the rearward-horizontal component of force required since the farther the weight of the user must be lifted up. It is noted that the rearward moving foot link has the user applying the rearward pushing force thereto and tends to carry most of the user's weight.

Generally, when the user is lengthening his stride by pushing farther rearward with one foot, the user moves the other foot forward by a similar increased amount and causes the foot link that foot is engaging to move forward relative to the roller 36 engaging the cam 88 of that foot link and the roller rolls rearward along the surface 90 toward the rearward stop 92 thereof. The amount of force applied with a forward-horizontal component to accomplish this relative movement between the forward moving foot link and the roller is significantly less than with the rearwardly moving foot link described immediately above. This is because the forward moving foot link is almost completely unweighted and the force needed to lift the foot link is mostly related to the weight of the foot link itself, which is not very large. Additionally, the momentum of the crank arm engaging the forward moving foot link and its direction of rotation tend to drive the foot link forward even without much, if any, help of the forward moving foot of the user. In use, the user will tend to shift his weight and begin the next stride due to the sensation felt with the rearward pushing leg, rather than because of any sensation felt with the forward moving leg which mostly just moves forward along with the forwardly moving foot link. It is noted that in another embodiment of the exercise machine 2 illustrated in FIG. 13 and described below, the left and right swing arms 10 and 12 are interconnected to produce a left-right dependency with respect to the rearward-forward swinging motion thereof. In that embodiment the rearward pushing movement on the rearward moving foot link drives the forward moving foot link forward without requiring any force applied by the user's forward moving foot thereto.

In the event the user does apply enough horizontal force to move one of the cams 88 relative to the roller 36 so that the roller engages one of the stop 92, further movement in that direction is prevented. The stop 92 essentially presents a wall to the roller beyond which it cannot pass due to its radius of curvature relative to the radius of the roller.

Since the radius of curvature of the surface 90 progressively decreases (i.e., the curvature increases) toward the stops 92, the increased energy the user must input dissuades moving the foot links 4 and 6 relative to the rollers 36 so far as to engage the stops. In fact, after several striding cycles by a user on the exercise machine 2, the progressively increasing nature of the force encountered when reaching the end of a long stride tends to train the user to sense and respond to the increasing in force to know when to shift his weight and avoid using overly long stride lengths that might drive the rollers 36 into the stops 92. The user tends to respond to this increase in force subconsciously and it stimulates a weight shift to begin a new stride while well within the physical parameters of the exercise machine 2 as manufactured. The additional resistance supplied by the resistance device 56, if operating, also tends to discourage overly long stride lengths. Generally, the more resistance the user selects for the resistance device 56 to supply, the shorter the stride used.

It is noted that if a user wishes to exercise allowing the rollers 36 to remain nested in the peaked central portions 89 of the surfaces 90 of the cams 88, no rearward pushing force is required by the one leg of the user to move the one foot link rearward, and no forward force is required by the other leg of the user to move the other foot link forward since the rotation of the crank arms 28 and 30 will move the foot links rearward and forward. The user generally must just shift his weight to keep up with the foot link movement resulting from the rotation of the crank arms. The speed at which the weight must be shifted depends, in part, on the resistance selected by the user to be applied by the resistance device 56 previously described. In this mode of operation, the length of the crank arms 28 and 30 determine the stride length as noted above.

When a user wishes to stride with a stride length shorter than that resulting from allowing the cams 88 to travel with the rollers 36 nested into the peaked central portion 89 of the surface 90, this is accomplished by the user somewhat resisting the tendency of the cams to be carried with the rollers 36 as the crank arms 28 and 30 rotate during an exercise. Effectively, the user must apply a forward moving force on the rearward moving foot link to which he would normally apply a rearward pushing force when desiring a long stride so as to drive the foot link forward relative to the roller 36 engaging it. Similarly, the user must apply a rearward moving force on the forward moving foot link to which he would normally apply a forward force so as to drive the foot link rearward relative to the roller 36 engaging it. This is not very difficult with a little practice, and produces a shortened stride length or even a jogging or stepping in place stride path that stimulates substantially different muscle involvement than for the exercises first described.

Use of the stops 92 ensures that the cam 88 securely captures, between its forward and rearward stops 92, the roller 36 of the one of the crank arms 28 and 30 supporting the foot link 4, 6 to which the cam is secured. The stops 92 are spaced longitudinally apart sufficient to allow significant relative rearward and forward motion between the foot link and the roller for the longest stride to be accommodated.

The foot links 4 and 6 of the embodiment of the exercise machine 2 shown in FIG. 4 each have a lowered mid-portion at which the foot engagement pads 44 and 46 are attached. This places the foot engagement pads 44 and 46 closer to the base 14, making stepping onto the foot links easier.

Figure 5:
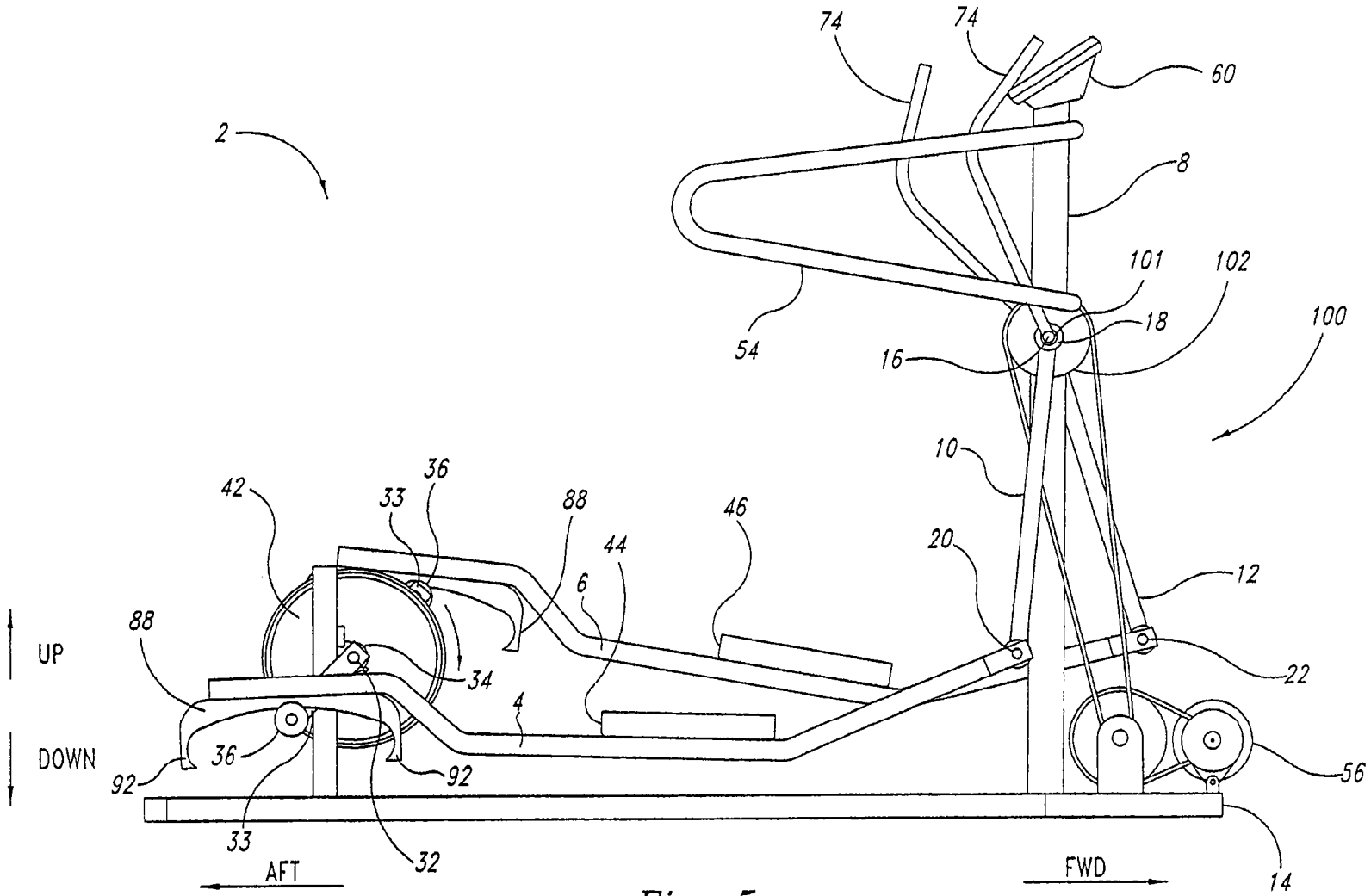
FIG. 5 illustrates a fourth alternative embodiment of the exercise device of the present invention similar to the embodiment of FIG. 4 having a resistance device resisting the horizontal component of the foot link motion but no resistance device for the vertical component.

A fourth alternative embodiment of the exercise machine 2 is shown in FIG. 5 with the above described resistance device 56 mounted at a forward end portion of the base 14 and coupled to resist the rearward-forward movement of the foot links 4 and 6, rather than the rotation of the crank arms 28 and 30. A conventional mechanical transmission 100 is used to connect the resistance device 56 to the foot links 4 and 6, through the swing arms 10 and 12. In particular, the transmission 100 includes pulleys and belts with a pulley 102 rigidly mounted on the axle 16, which is in this embodiment rotatably mounted to the pedestal 8. Each of the swing arms 10 and 12 has its bearing journal 18 mounted to a corresponding free end portion of the axle 16 via a ratchet clutch assembly 101 that converts the oscillating swinging motion of swing arms 10 and 12 into a unidirectional rotational motion of the axle 16. This unidirectional rotation is transmitted to the pulley 102 affixed to the axle and engaged by one of the belts of the transmission system 100. By such interconnection, the rearward-forward movement of the foot links 4 and 6 is resisted with a user selected degree of resistance by the resistance device 56. Alternative brake designs may be used. With the resistance device 56 arranged as shown in FIG. 5, the user experiences a resistance to the input rearward-forward-striding motion and thereby achieves increased exercise. The resistance device 56 is electrically coupled to the control panel 60 for accepting user commands that control the resistance level of the resistance device.

In the embodiment of FIG. 5, having a forwardly mounted resistance device 56, the pulley 42 mounted at the rearward end of the base 14 is weighted to act as a flywheel to smooth the reciprocating operation of the foot links 4 and 6, and the rotation of the crank arms 28 and 30.

Figure 6:
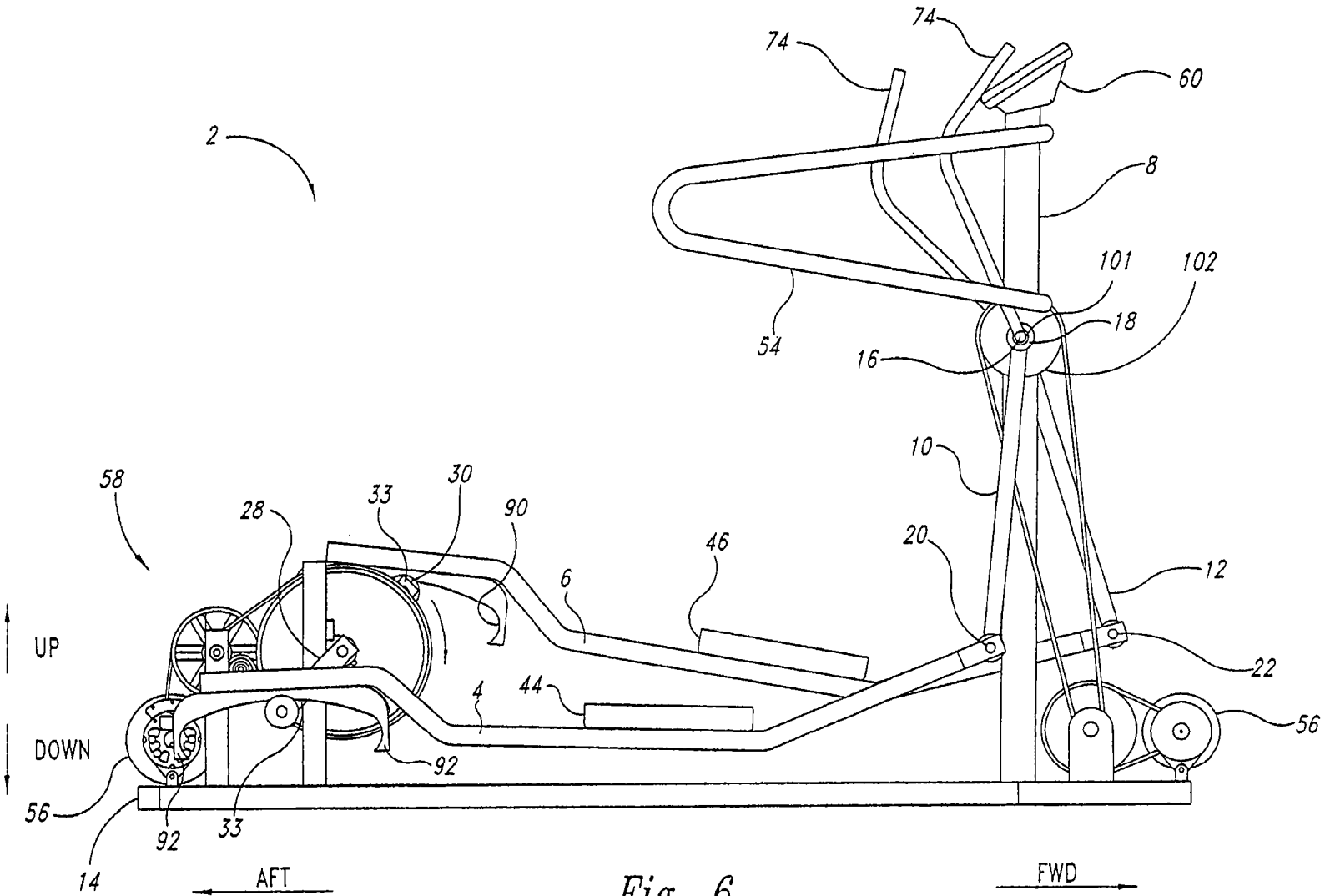
FIG. 6 illustrates a fifth alternative embodiment of the exercise device of the present invention similar to the embodiments of FIG. 4, wherein separate resistance devices resist the vertical and horizontal components of the foot link motion.

A fifth alternative embodiment of the exercise machine 2 is shown in FIG. 6 using two resistance devices 56, one mounted at the forward end of the base 14 to selectively resist the rearward-forward movement of the foot links 4 and 6 as described above for the embodiment of FIG. 5, and one mounted at the rearward end of the base 14 to selectively resist the rotation of the crank arms 28 and 30 as described above for the embodiment of FIG. 1. Both the fore and aft resistance devices 56 are electrically coupled to the user control panel 60 mounted on the pedestal 8, whereby the user is able to input directions controlling the operation of the resistance devices and thereby the level of each of the fore and aft braking applied.

Figure 7:
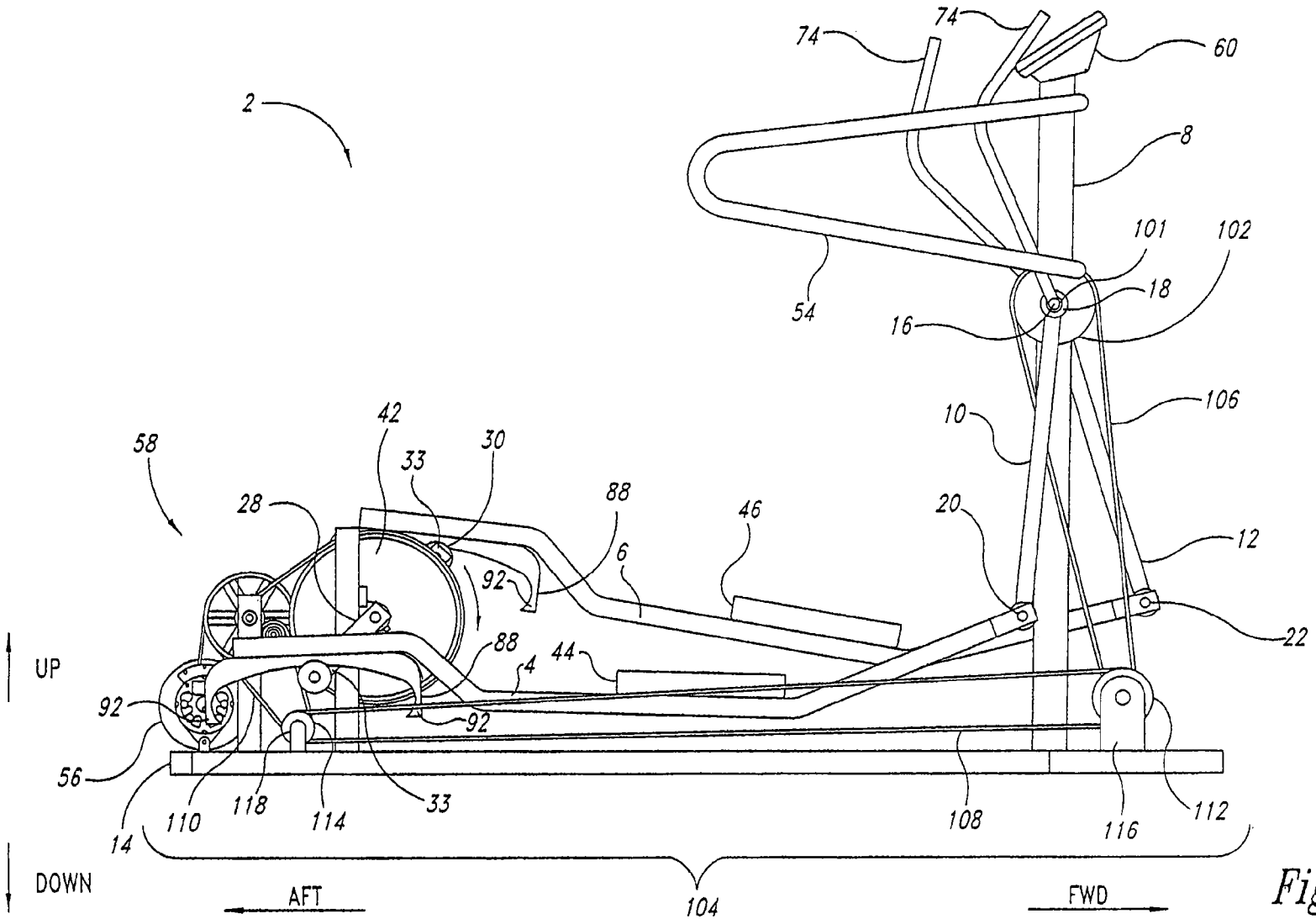
FIG. 7 illustrates a sixth alternative embodiment of the exercise device of the present invention similar to the embodiment of FIG. 4, wherein a single resistance device resists both the vertical and horizontal components of foot link motion.

A sixth alternative embodiment of the exercise machine 2 is shown in FIG. 7, using a single resistance device 56 mounted at the rearward end of the base 14 but coupled to resist both the rearward-forward movement of the foot links 4 and 6 and the rotation of the crank arms 28 and 30, much as with the embodiment of FIG. 6 but using a single resistance device. In this embodiment, the pulley 102 is connected by a chain or belt 106 to an idler set of gears or pulleys 112 supported by a pair of stanchions 116 to the forward end of the base 14. The idler set of gears/pulleys 112 is connected by a chain or belt 108 to another idler set of gears or pulleys 114 supported by a pair of stanchions 118 to the rearward end of the base 14. The idler gears/pulleys 114 are connected by a chain or belt 110 to the resistance device 56 via the transmission 58. Striding motions input by the user at foot engagement pads 44 and 46 are resisted by the resistance device 56 under the user's control to require a user directed increased effort to perform the striding exercise. The single resistance device embodiment described is just one example of many resistance and transmission configurations possible and contemplated by the invention.

FIGS. 9 through 11 illustrate three of the many pseudo-elliptical stride paths of the foot engagement pads 44 and 46 that may be produced using the exercise machine 2. FIG. 9, for example, illustrates a path 120 followed by a user inputting a stride length into the foot engagement pads 44 and 46 that follows the path traced when the rollers 36 remain in the peaked central portion 89 of the surface 90 of the cams 88, where the stride length is about twice the length of the crank arms 28 and 30, as described above.

FIG. 10 illustrates a shortened pseudo-elliptical stride path 122 than shown in FIG. 9, resulting from a shorter than normal stride, which is less than the combined lengths of the crank arms 28 and 30. In FIG. 10 it can be seen that rollers 36 are angularly displaced forward and rearward of the peaked central portion 89 of the surface 90 by an angle $-\alpha$ for the left foot link 6 relative to the corresponding left roller 36, and by an angle $+\alpha$ for the right foot link 4 relative to the corresponding right roller 36. Such angular displacement of the cams 88 relative to rollers 36 requires relatively little effort by the user when the displacement is small because the radius of curvature for the surface 90 is relatively large compared to the radius of the roller 36 in the area of the surface 90 just forward and rearward of the peaked central portion 89 of the surface 90. However, as described above, greater linear displacements of the foot links 4 and 6 relative to the rollers 36 on the crank arms 28 and 30, respectively, requires greater energy input as the angular displacement angle $\alpha$ increases.

FIG. 11 illustrates an extended pseudo-elliptical stride path 124 that is longer than the normal stride input by the user, and longer than the combined lengths of crank arms 28 and 30. In FIG. 11 it can be seen that rollers 36 are angularly displaced rearward and forward of the peaked central portion 89 of the surface 90, to the opposite side thereof than shown in FIG. 10, by an angle $+\beta$ for the left foot link 6 relative to the corresponding left roller 36 and an angle $-\beta$ for the right foot link 4 relative to the corresponding right roller 36. As discussed above, such large angular displacements of the cams 88 relative to the rollers 36 requires progressively increasing effort by the user because the radius of curvature for the surface 90 progressively decreases along the surface 90 when moving forward or rearward of the peaked central portion 89 of the surface. Reaching the linear displacement of the foot links 4 and 6 relative to the rollers 36 on the crank arms 28 and 30, respectively, to produce the angular displacement $\beta$ requires greater energy input by the user. The position of the right foot link 4 shown in FIG. 11 is similar to ending the stride at Position No. 5 of the cam 88 shown in FIG. 17.

FIG. 12 illustrates a seventh alternative embodiment of exercise machine 2 which replaces the crank arms 28 and 30 with a different reciprocating arrangement which provides a purely vertical upward and downward motion at the rearward ends of the foot links 4 and 6. In particular, a reciprocator 126 supported on the rearward end portion of the base 14 has a pulley or gear 126 rotatably mounted to the stanchions 24 with a flexible member 128 such as a cable or chain passing over the pulley 126. A left side end of the flexible member 128 is secured to a left reciprocating member 131 guided by a guide rod 130*a* to reciprocate upward and downward, and a right side end of the flexible member 128 is secured to a right reciprocating member 131 guided by a guide rod 130*b* to reciprocate upward and downward. Each of the reciprocating members has a sleeve secured thereto and slidably disposed on a corresponding one of the guide rods 130*a* and 130*b*. The left and right side rollers 36 which support the cams 88, and hence the foot links 4 and 6, are rotatably mounted on spindles of a corresponding one of the left and right reciprocating members 131 for upward and downward movement therewith.

By the interconnection of the left and right reciprocating members 131 using the flexible member 128, when the one reciprocating member moves downward toward the base 14 under the weight of the user on the foot link supported by the roller 36 attached to that reciprocating member, the other reciprocating member moves upward and carries upward the roller attached thereto and the foot link supported by that roller. Thus, the same downward-upward movement produced by the crank arms 28 and 30 used in other described embodiments is achieved. The interconnection of the reciprocating members 131 through the flexible member 128 forces the left and right reciprocating members to move downward and upward in equal and opposite reciprocating motions (i.e., left-right dependency exists for the vertical component of movement). Other mechanisms can be used to create substantially the same left-right vertical dependency described herein.

In operation, the shifting of the user's body weight applied to the foot engagement pads 44 and 46 is transmitted through the corresponding cams 88 at the rearward end of the corresponding foot links 4 and 6 to the corresponding reciprocating members 131 through the rollers 36 attached thereto to produce reciprocating downward and upward movement of the rearward end portions of the foot links 4 and 6. The rearward-forward movement of the foot links 4 and 6 responds to the rearward-forward movement of the user's feet as described above for other embodiments. With the embodiment of FIG. 12 it is easy to operate the exercise machine with a jogging or stepping in place movement with little or no rearward-forward movement, or to produce a stride length of the length desired by the user in response to the movement of the user's legs. As with all described embodiments of the invention, the exercise machine 2 conforms to the stride length selected by the user, rather than restricting the user to the stride path length of the machine, i.e., the exercise machine conforms to the user rather than forcing the user to conform to the machine.

Figure 13:
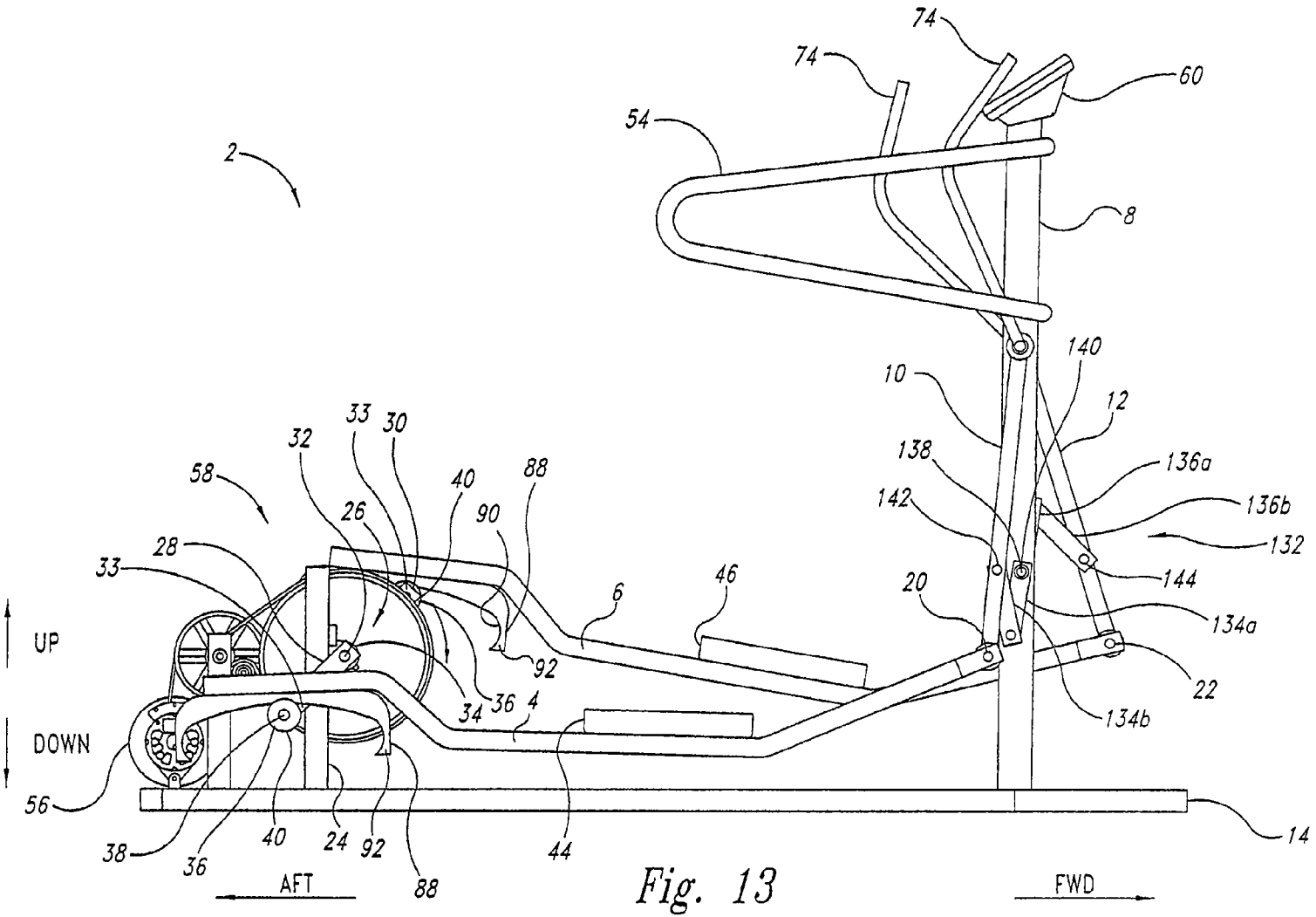
FIG. 13 illustrates an eighth alternative embodiment of the exercise device of the present invention similar to the embodiment of FIG. 4 having interdependent swing arms.

An eighth embodiment of the exercise machine 2 is shown in FIG. 13. This embodiment is generally the same as the embodiment of FIG. 4 except that the left and right swing arms 10 and 12 are interconnected to produce a left-right dependency with respect to the rearward-forward swinging motion thereof. A reciprocator or bell crank assembly 132 interconnects the left and right swing arms 10 and 12. The crank assembly 132 includes right and left crank arms 134*a* and 136*a* rigidly attached to opposite ends of a transverse axle 138 rotatably mounted to the pedestal 8 by a bushing or bearing 140. A distal end of each of the crank arms 134*a* and 136*a* is pivotally coupled to an end of a respective one of arms 134*b* and 136*b*. The opposite end of each of the arms 134*b* and 136*b* is pivotally coupled to a respective one of the swing arms 10 and 12 by a respective one of pins 142 and 144. This arrangement of crank arms 134*a* and 136*a* and arms 134*b* and 136*b*, serve as double overhung cranks to interconnect the swinging motion of the swing arms 10 and 12, such that when a user's striding motion input at foot engagement pads 44 and 46 drives one of the swing arms to swing rearward, the other is caused to swing forward through the action of the crank assembly 132.

This produces left-right "dependency" of the rearward-forward motions of the swing arms 10 and 12, and also of the foot links 4 and 6 to which the swing arms are connected. Thus, while the user dynamically controls the effective length of stride input at each of foot engagement pads 44 and 46, the crank assembly 132 coordinates or "matches" the rearward-forward movements of the foot engagement pads 44 and 46. In the embodiment of FIG. 13, the movement of the right and left lever arms 74 is also coordinated with the rearward-forward movements of the foot engagement pads 44 and 46, although the movement is in the opposite direction. With the dependent motion of the foot links 4 and 6, when the user applies a rearward pushing force to one of the foot links during a striding motion, the rearward movement of the foot link, through the crank assembly 132 drives the other foot link forward. This eliminates any concern over timing that might result from improper coordination of the rearward-forward movements of the foot links 4 and 6, and assures that the rearwardly positioned foot link is always moved properly forward in preparation for the next stride using that foot link. Further, the left-right dependency tends to make starting movement of the foot links 4 and 6 in the direction desired for forward or rearward striding easier since the foot link movements are mechanically coordinated and do not require the user to insure proper coordinated movement occurs when first starting an exercise, i.e., if one foot link begins to move rearward, the other must be moved forward. There are other mechanisms that may be used for achieving this left-right dependency of the rearward-forward motion of the foot links 4 and 6, such as pivoting rocker arm assemblies, reversing rotational hubs about pivoting axes, and flexible members (chain/belt) connected to the swing arms 10 and 12 and traveling around an idler pulley therebetween.

Figure 14:
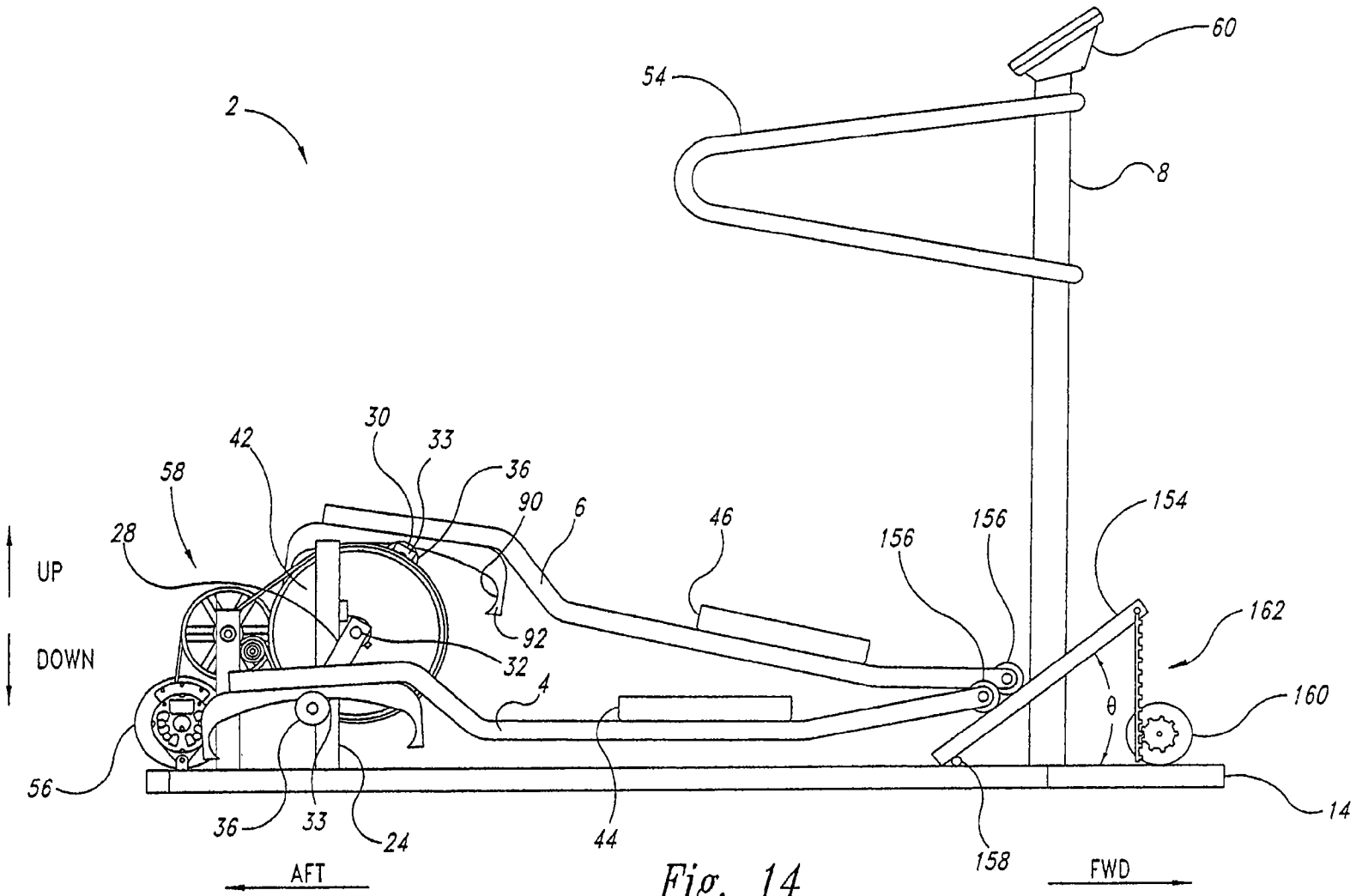
FIG. 14 illustrates a ninth alternative embodiment of the exercise device of the present invention having the forward ends of the two foot links configured to each slidingly or rollingly engage a variably inclinable ramp.

FIG. 14 illustrates a ninth alternative embodiment of the exercise machine 2. In this embodiment the swing arms 10 and 12 have been replaced with variably inclinable right and left tracks or ramps 154 to guide the forward ends of the foot links 4 and 6 while they reciprocate rearwardly and forwardly. The forward ends of the foot links 4 and 6 each have a roller 156 attached thereto and are configured to rollingly engage the corresponding one of the inclined tracks 154 for movement therealong. The inclined tracks 154 are configured to guide the forward ends of the foot links 4 and 6 in respective reciprocating, angularly upward linear motions very similar to the motion produced by the swing arms 10 and 12 but along a straight path rather than the arcuate path "A" shown in FIG. 1. Other suitable alternative mechanical arrangements are contemplated for providing guided motion of the forward ends of the foot links 4 and 6 such as having the ends of the foot links slidably engaging a guide track or rail.

The angle of incline of tracks 154 is adjustable relative to base 14 about a hinge 158. The inclination angle θ between the tracks 154 and the base 14 is adjustable in response to a user command input at control panel 60 which controls a drive motor 160 connected to raise and lower the tracks 154 via a connector member 162. Varying the inclination of the tracks 154 (angle θ) increases and decreases the effort required by the user performing the exercise and changes the shape of the pseudo-elliptical stride path produced at the foot engagement pads 44 and 46.

Figure 15:
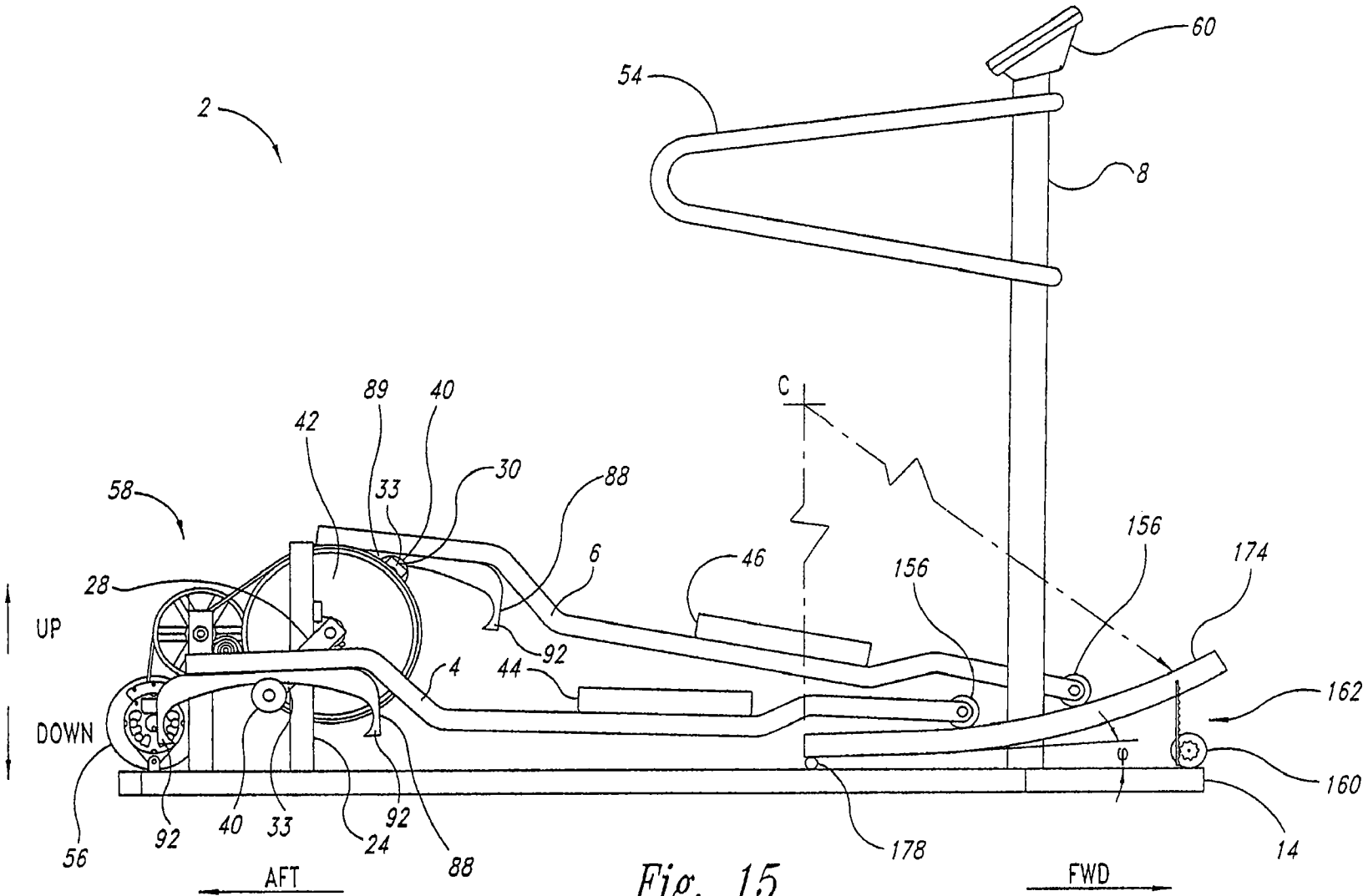
FIG. 15 illustrates a tenth alternative embodiment of the exercise device of the present invention having the forward ends of the two foot links configured to each slidingly or rollingly engage a variably inclinable curved ramp.

FIG. 15 illustrates a tenth alternative embodiment of the exercise machine 2, wherein the rollers 156 at the forward ends of the foot links 4 and 6 are guided with variably inclinable curved ramps or tracks 174 as the foot links reciprocate rearwardly and forwardly. The variably inclinable tracks 174 can be used with a rate of curvature that changes along the length of the tracks to control the effort required of the user performing the exercise and the shape of the pseudo-elliptical stride path produced. If desired, the shape of the tracks 174 can be curved to produce the same movement produced by the swing arms 10 and 12 in the earlier described embodiments.

The angular inclination ϕ of the curved tracks 174 is adjustable relative to base 14 in the embodiment of FIG. 15 about a hinge 178. The inclination angle ϕ between the tracks 174 and the base 14 is adjustable in response to a user command input at the control panel 60.

Figure 16:
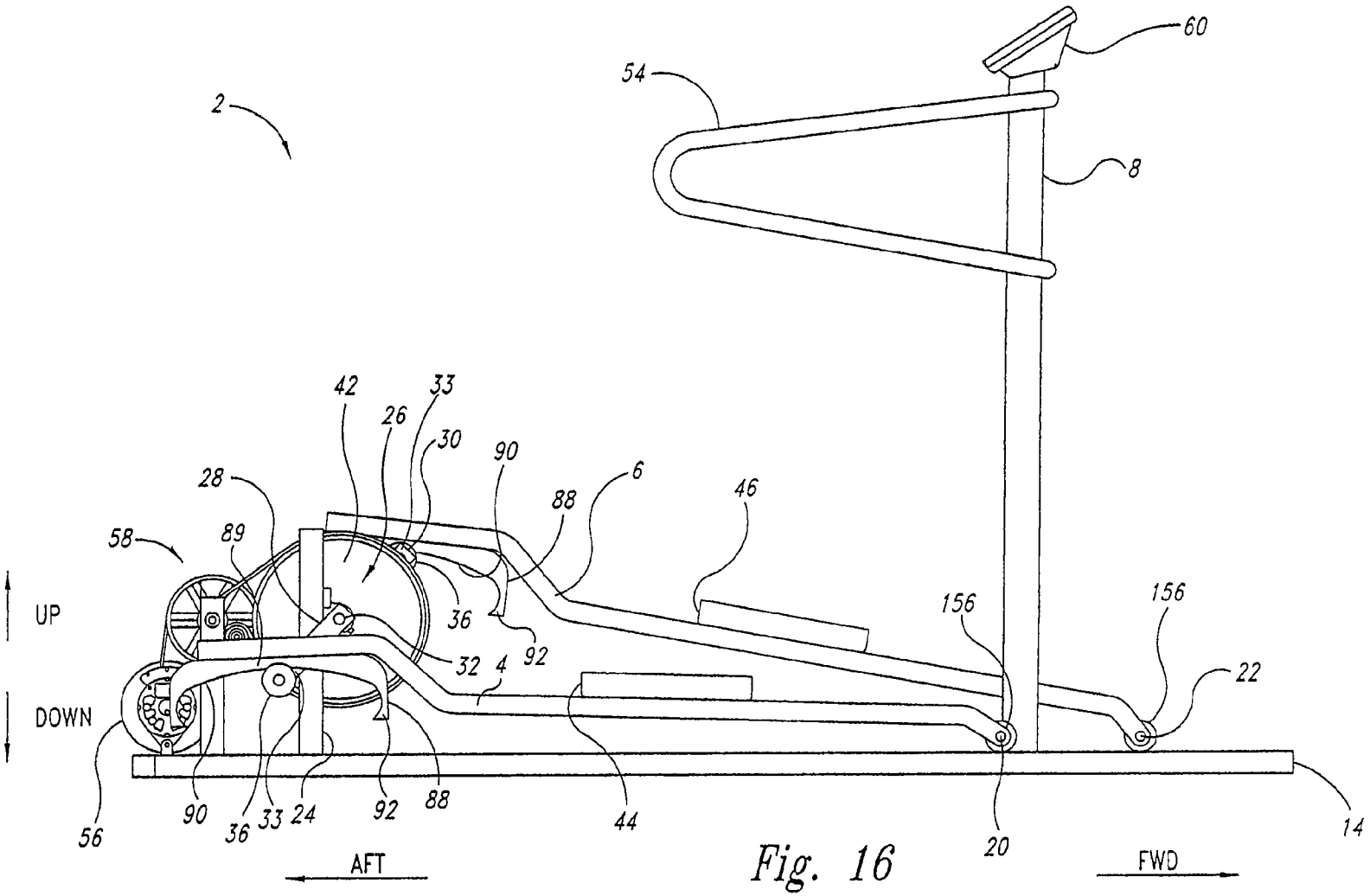
FIG. 16 illustrates an eleventh alternative embodiment of the exercise device of the present invention having the forward ends of the two foot links configured to each slidingly or rollingly engage a horizontal surface.

An eleventh alternative embodiment of the exercise machine 2 is shown in FIG. 16. In this embodiment, the rollers 156 at the forward ends of the foot links 4 and 6 are guided by a horizontal surface portion of the base 14 as the foot links 4 and 6 reciprocate rearwardly and forwardly. Alternatively, a sliding member or another suitable mechanical device can be mounted on the forward ends of the foot links 4 and 6 for engaging the base 14 or some guide formed in or provided on the base, such as a guide channel, rail or device to restrict lateral movement of the forward ends of the foot links while allowing their rearward-forward movement.

Figure 18:
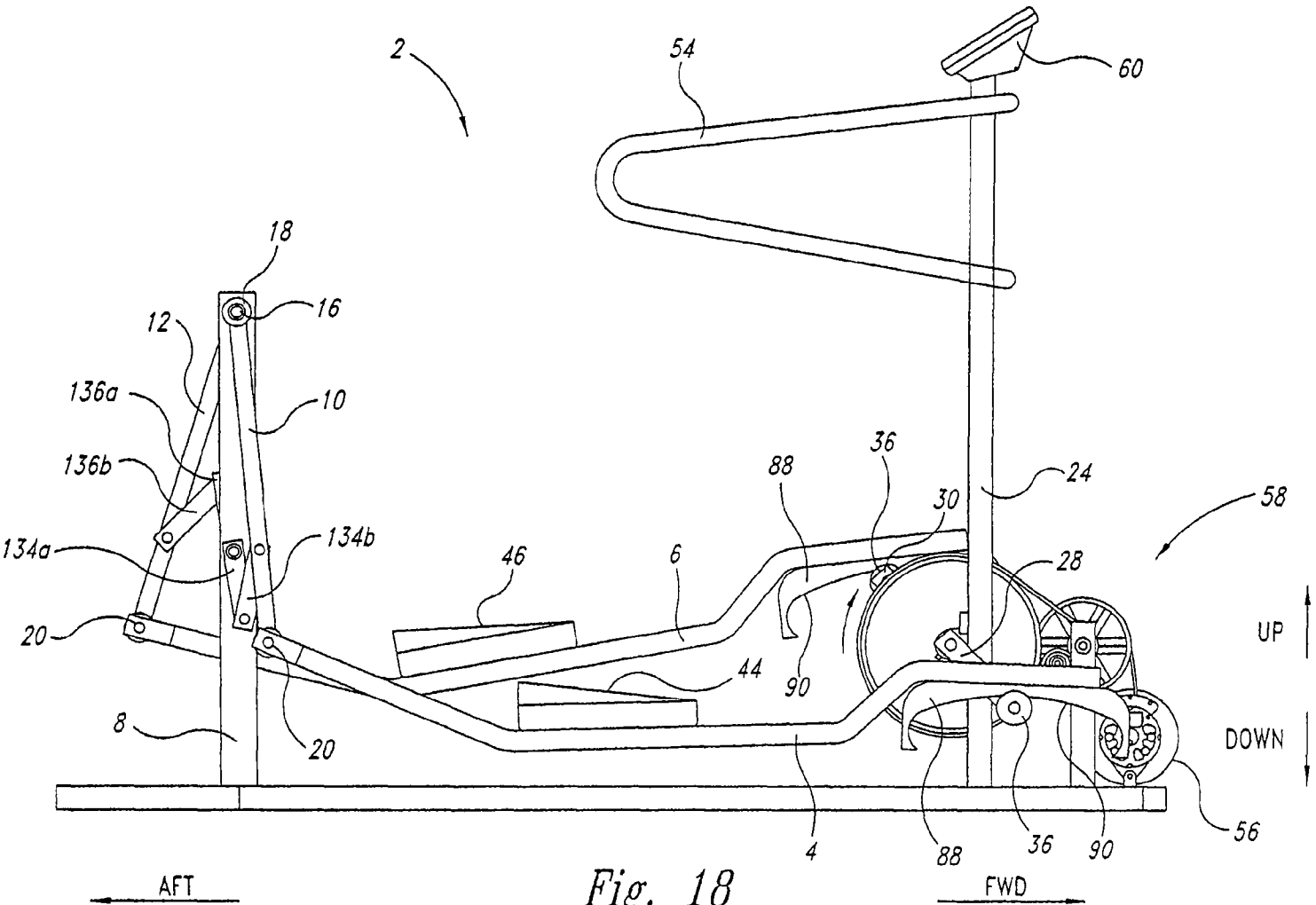
FIG. 18 illustrates a twelfth alternative embodiment of the exercise device of the present invention similar to the embodiment of FIG. 13 with the foot links rollably supported at a forward end by the rollers of the crank arms, and supported at a rearward end by the swing arms.

A twelfth alternative embodiment of the exercise machine 2 is shown in FIG. 18. This embodiment is similar to the embodiment of FIG. 13 except that the forward end portions of the foot links 4 and 6 have the cams 88 and are supported by the crank arms 28 and 30 of the crank assembly 26, and the rearward end portions of the foot links are supported by the swing arms 10 and 12. The handle bar 54 and the control panel 60 are attached to an upward extension of the stanchions 24, rather than to the upper end portion of the pedestal 8. The foot engagement pads 44 and 46 are angled to provide a comfortable feel to the user, but this can also be provided by other means, such as providing a different contour to the foot links 4 and 6.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. An exercise device, comprising:

a frame;

a first member and a second member operatively associated with the frame;

a first crank arm and a second crank arm operatively associated with the frame and configured to rotate about a crank axis;

a first variable stride member operatively associated with the first crank arm and the first member, the first variable stride member comprises a first link including a first cam, and the first variable stride member is operatively associated with the first crank arm by engagement of the first cam with the first crank arm;

a second variable stride member operatively associated with the second crank arm and the second member, the second variable stride member comprises a second link including a second cam, and the second variable stride member is operatively associated with the second crank arm by engagement of the second cam with the second crank arm;

a first foot engagement portion operatively associated with the first variable stride member;

a second foot engagement portion operatively associated with the second variable stride member;

the first member, the first crank arm, and the first variable stride member configured such that a user may dynamically vary a travel path of the first foot engagement portion by varying the user's stride; and the second member, the second crank arm, and the second variable stride member configured such that a user may dynamically vary a travel path of the second foot engagement portion by varying the user's stride.

2. The exercise device of claim 1, wherein the first member comprises a first swing arm and the second member comprises a second swing arm.

3. The exercise device of claim 1, wherein:

the first link comprises a first foot link;

the second link comprises a second foot link;

the first foot engagement portion is operatively associated with the first variable stride member by supporting the first engagement portion using the first foot link; and the second foot engagement portion is operatively associated with the second variable stride member by supporting the second engagement portion using the second foot link.

4. The exercise device of claim 1, further comprising:

a first roller supported by the first crank arm;

a second roller supported by the second crank arm;

the first cam engaged with the first crank arm via the first roller; and the second cam engaged with the second crank arm via the second roller.

5. An exercise device, comprising:

a frame;

a first member and a second member operatively associated with the frame;

a first crank arm and a second crank arm operatively associated with the frame and configured to rotate about a crank axis;

a first variable stride member operatively associated with the first crank arm and the first member, the first variable stride member comprises a first cam member;

a second variable stride member operatively associated with the second crank arm and the second member, the second variable stride member comprises a second cam member;

the first variable stride member is operatively associated with the first crank arm by engagement of the first cam member with the first crank arm;

the second variable stride member is operatively associated with the second crank arm by engagement of the second cam member with the second crank arm;

a first foot engagement portion operatively associated with the first variable stride member;

a second foot engagement portion operatively associated with the second variable stride member;

the first member, the first crank arm, and the first variable stride member configured such that a user may dynamically vary a travel path of the first foot engagement portion by varying the user's stride; and the second member, the second crank arm, and the second variable stride member configured such that a user may dynamically vary a travel path of the second foot engagement portion by varying the user's stride.

6. The exercise device of claim 5, further comprising:

a first roller supported by the first crank arm;

a second roller supported by the second crank arm;

the first cam member engaged with the first crank arm via the first roller; and the second cam member engaged with the second crank arm via the second roller.

7. An exercise device, comprising:

a frame;

a first member and a second member operatively associated with the frame, the first member operatively associated with the frame by pivotally connecting the first member to the frame, and the second member operatively associated with the frame by pivotally connecting the second member to the frame;

a first crank arm and a second crank arm operatively associated with the frame and configured to rotate about a crank axis;

a first variable stride member operatively associated with the first crank arm and the first member, the first variable stride member is operatively associated with the first member by pivotally connecting the first variable stride member to the first member, first variable stride member includes a first curved surface, and the first variable stride member operatively associated with the first crank arm by engagement of the first curved surface with the first crank arm;

a second variable stride member operatively associated with the second crank arm and the second member, the second variable stride member is operatively associated with the second member by pivotally connecting the second variable stride member to the second member, the second variable stride member includes a second curved surface, and the second variable stride member is operatively associated with the second crank arm by engagement of the second curved surface with the second crank arm;

a first foot engagement portion operatively associated with the first variable stride member, the first foot engagement portion is operatively associated with the first variable stride member by supporting the first foot engagement portion using the first variable stride member;

a second foot engagement portion operatively associated with the second variable stride member, the second foot engagement portion operatively associated with the second variable stride member by supporting the second foot engagement portion using the second variable stride member;

the first member, the first crank arm, and the first variable stride member configured such that a user may dynamically vary a travel path of the first foot engagement portion by varying the user's stride; and the second member, the second crank arm, and the second variable stride member configured such that a user may dynamically vary a travel path of the second foot engagement portion by varying the user's stride.

8. An exercise device, comprising:

a frame;

a first member and a second member operatively associated with the frame;

a first variable stride member operatively associated with the first member, the first variable stride member comprises a first link including a first cam;

a second variable stride member operatively associated with the second member, the second variable stride member comprises a second link including a second cam;

a first foot engagement portion operatively associated with the first variable stride member;

a second foot engagement portion operatively associated with the second variable stride member;

a system operatively associated with the frame, the first variable member and the second variable member;

a first roller supported by the system;

a second roller supported by the system;

the first variable stride member is operatively associated with the system by engagement of the first cam with the first roller;

the second variable stride member is operatively associated with the system by engagement of the second cam with the second roller;

the first variable stride member and the system configured to raise and lower the first foot engagement portion during movement of the first foot engagement portion through a travel path;

the second variable stride member and the system configured to raise and lower the second foot engagement portion during movement of the second foot engagement portion through a travel path;

the first member, the system, and the first variable stride member configured such that a user may dynamically vary the travel path of the first foot engagement portion by varying the user's stride; and the second member, the system, and the second variable stride member configured such that a user may dynamically vary the travel path of the second foot engagement portion by varying the user's stride.

9. The exercise device of claim 8, wherein the first member comprises a first swing arm and the second member comprises a second swing arm.

10. The exercise device of claim 8, wherein the system comprises:

a first crank arm configured to rotate about a crank axis and operatively associated with the first variable stride member;

a second crank arm configured to rotate about the crank axis and operatively associated with the second variable stride member.

11. The exercise device of claim 8, wherein:

the first link comprises a first foot link;

the second link comprises a second foot link;

the first foot engagement portion is operatively associated with the first variable stride member by supporting the first engagement portion using the first foot link; and the second foot engagement portion is operatively associated with the second variable stride member by supporting the second engagement portion using the second foot link.

12. An exercise device comprising:

a frame;

a first member and a second member operatively associated with the frame;

a first variable stride member operatively associated with the first member, the first variable stride member comprises a first cam member;

a second variable stride member operatively associated with the second member, the second variable stride member comprises a second cam member;

a first foot engagement portion operatively associated with the first variable stride member;

a second foot engagement portion operatively associated with the second variable stride member;

a system operatively associated with the frame, the first variable member and the second variable member;

the first variable stride member operatively associated with the system by engagement of the first cam with the system; the second variable stride member operatively associated with the system by engagement of the second cam with the system the first variable stride member and the system configured to raise and lower the first foot engagement portion during movement of the first foot engagement portion through a travel path;

the second variable stride member and the system configured to raise and lower the second foot engagement portion during movement of the second foot engagement portion through a travel path;

the first member, the system, and the first variable stride member configured such that a user may dynamically vary the travel path of the first foot engagement portion by varying the user's stride; and the second member, the system, and the second variable stride member configured such that a user may dynamically vary the travel path of the second foot engagement portion by varying the user's stride.

13. The exercise device of claim 12, further comprising:

a first roller supported by the system;

a second roller supported by the system;

the first cam engaged with the system via the first roller; and the second cam engaged with the system via the second roller.

14. An exercise device, comprising:

a frame;

a first member and a second member operatively associated with the frame, the first member operatively associated with the frame by pivotally connecting the first member to the frame, and the second member operatively associated with the frame by pivotally connecting the second member to the frame;

a first variable stride member operatively associated with the first member;

a second variable stride member operatively associated with the second member;

a first foot engagement portion operatively associated with the first variable stride member;

a second foot engagement portion operatively associated with the second variable stride member;

a system operatively associated with the frame, the first variable member and the second variable member;

the first variable stride member operatively associated with the first member by pivotally connecting the first variable stride member to the first member;

the first variable stride member includes a first curved surface and the first curved stride member operatively associated with the system by engagement of the first curved surface with the system;

the second variable stride member operatively associated with the second member by pivotally connecting the second variable stride member to the second member;

the second variable stride member includes a second curved surface and the second variable stride member is operatively associated with the second crank arm by engagement of the second curved surface with the system;

the first foot engagement portion operatively associated with the first variable stride member by supporting the first foot engagement portion using the first variable stride member;

the second foot engagement portion operatively associated with the second variable stride member by supporting the second foot engagement portion using the second variable stride member;

the first variable stride member and the system configured to raise and lower the first foot engagement portion during movement of the first foot engagement portion through a travel path;

the second variable stride member and the system configured to raise and lower the second foot engagement portion during movement of the second foot engagement portion through a travel path;

the first member, the system, and the first variable stride member configured such that a user may dynamically vary the travel path of the first foot engagement portion by varying the user's stride; and the second member, the system, and the second variable stride member configured such that a user may dynamically vary the travel path of the second foot engagement portion by varying the user's stride.

* * * * *